US007237491B2

(12) United States Patent
Faucher et al.

(10) Patent No.: US 7,237,491 B2
(45) Date of Patent: Jul. 3, 2007

(54) VARIABLE FUNCTION PERSON TRANSPORTATION SYSTEM(S)

(75) Inventors: Martin Faucher, Katevale (CA); Michel Corriveau, Eaton (CA)

(73) Assignee: BHM Medical Inc., Saint-John, New-Brunswick (CA)

( * ) Notice: Subject to any disclaimer, the term of this patent is extended or adjusted under 35 U.S.C. 154(b) by 77 days.

(21) Appl. No.: 11/193,404

(22) Filed: Aug. 1, 2005

(65) Prior Publication Data

US 2006/0002252 A1 Jan. 5, 2006

Related U.S. Application Data

(63) Continuation of application No. 10/762,370, filed on Jan. 23, 2004, now abandoned, which is a continuation of application No. 09/985,282, filed on Nov. 2, 2001, now abandoned.

(51) Int. Cl.
*B61B 3/00* (2006.01)
*A61G 7/10* (2006.01)

(52) U.S. Cl. ..... 104/89; 5/85.1

(58) Field of Classification Search ..... 104/89, 104/90, 91; 105/148, 150; 5/81.1 R, 83.1, 5/85.1

See application file for complete search history.

(56) References Cited

U.S. PATENT DOCUMENTS

| | | | | |
|---|---|---|---|---|
| 1,951,139 | A | | 3/1934 | Fahrney |
| 2,024,947 | A | | 12/1935 | Racklyeft |
| 2,630,076 | A | | 3/1953 | Stieve |
| 2,905,294 | A | | 9/1959 | Kellogg |
| 3,000,329 | A | | 9/1961 | Fargo |
| 3,643,770 | A | | 2/1972 | Faulds |
| 3,721,324 | A | | 3/1973 | Schweizer |
| 3,877,421 | A | | 4/1975 | Brown |
| 4,243,147 | A | * | 1/1981 | Twitchell et al. ..... 212/284 |
| 4,372,452 | A | | 2/1983 | McCord |
| 4,458,795 | A | | 7/1984 | Norton |

(Continued)

FOREIGN PATENT DOCUMENTS

| | | |
|---|---|---|
| WO | WO 88/09159 | 12/1988 |
| WO | WO 99/55277 | 11/1999 |
| WO | WO 01/74285 | 10/2001 |

*Primary Examiner*—S. Joseph Morano
*Assistant Examiner*—Robert J. McCarry, Jr.

(57) ABSTRACT

A winch assembly comprising a) a person lowering and raising winch component attached to a carriage component, the carriage component being configured for coupling to a carriage track of an overhead support for displacement thereof along the carriage track and b) a carriage displacement component for inducing displacement of the carriage component along the carriage track, the carriage displacement component comprising an electric motor element and a clutch coupling element the electric motor element being configured for providing driving effort for the displacement of the carriage component along the carriage track the clutch coupling element being configured for coupling and de-coupling the driving effort of the electric motor element such that when the driving effort of the electric motor element is coupled and the electric motor element is energised the carriage component may be urged along the carriage track by the electric motor element and when the driving effort of the electric motor element is de-coupled the carriage component may be manually displaced along the carriage track.

20 Claims, 21 Drawing Sheets

U.S. PATENT DOCUMENTS 5,337,908 A 8/1994 Beck, Jr.
5,379,468 A 1/1995 Cassidy et al.
5,649,329 A 7/1997 Horcher et al.
5,694,654 A 12/1997 Roy
5,809,591 A * 9/1998 Capaldi et al. ..... 5/83.1
6,085,368 A * 7/2000 Robert et al. ..... 5/85.1

* cited by examiner

VARIABLE FUNCTION PERSON TRANSPORTATION SYSTEM(S)

The present is a continuation of U.S. patent application Ser. No. 10/762,370 filed on Jan. 23, 2004 now abandoned which is a continuation of Ser. No. 09/985,282 filed on Nov. 2, 2001 now abandoned.

The present invention relates to load (e.g. person) transportation systems. It in particular relates to load (e.g. person) transportation systems which comprise one or more motorized units which are energized, for example by one or more electrical batteries, the systems including energy stations for the recharge of any such batteries. The present invention more particularly relates to a patient-handling system or apparatus which gives an operator the possibility of choosing between a manual or a motorised horizontal displacement of a person, e.g. of a (non-ambulatory) patient.

Support structures are known for lifting and transferring loads as well as people; please see for example U.S. Pat. Nos. 5,809,591, 5,694,654, 5,337,908 and 3,000,329; please also see for example U.S. Pat. No. 6,085,368, the entire contents of which is hereby incorporated by reference, which relates to a winch assembly for such a person handling system. It is known for example to exploit adjustable mast or pole support structures for use with overhead rails or tracks for forming support structures or frames (see for example U.S. Pat. No. 3,000,329 and 2,630,076). The entire contents of all of the above mentioned US patents are hereby incorporated by reference.

It is in particular known to use an overhead track or track system as part of a people displacement device or system. Such a track or track system may be directly bolted or otherwise fixed to the ceiling of a room. Alternatively such a track or track system may be maintained in place by a mast, pole or support rod assembly(ies). These structures may thus be intended to be more or less permanent fixtures or may be structures which may be able to be easily taken apart for the purpose of being rebuilt at some other location.

The present invention will be discussed herein after, in particular, with respect to a device(s) or system(s) for displacing (e.g. lifting, transporting, lowering, etc.) a person between various positions or areas such as for example between a bed and a chair, a bed and a bathroom etc. The clutch devices or assemblies of the present invention may of course be used for the displacement of any other type of load.

There is a continuing need for structures for supporting a person and in particular for a rail or track support structure or frame which can be used to raise, displace and lower a (e.g. incapacitated) person. Such support structures may be needed in many types of environments such as, for example, in private homes, hospitals, rehabilitation centres, group homes for the aged, etc. Such structures may, for example, be used to facilitate the transfer a bed ridden person from a bed to a wheel chair, to a bath tub or the like. Examples of lift devices are disclosed in U.S. Pat. Nos. 3,877,421, 5,379,468 and 5,649,329. The entire contents of all of the above mentioned US patents are hereby incorporated by reference.

It is known to provide a person handling system comprising a winch mechanism associated with a support rail or track, the support rail being attached or disposed adjacent to a ceiling. The winch mechanism may, for example, be attached or connected to the rail or track via a carriage (or a trolley) component. A trolley electric motor may be provided for inducing displacement of the carriage component along the rail. Such systems may also include one or more recharging station for the recharge of motor battery (ies) as well as means for (automatically) inducing the winch mechanism to travel to and electrically engage the recharging station for recharge of the battery(ies).

A drawback of such motor induced displacement of the carriage is that the displacement may be preset at a relatively slow predetermined speed (i.e. for safety reason). However, occasions may arise when an operator may wish for a more speedy displacement of the winch mechanism; such more speedy displacement may be necessary or desired if for some reason the winch mechanism itself is obstructing, hampering or delaying some desired or necessary activity. For example, a difficulty with the automatic return to the charging station is that the displacement of the carriage along a rail and the to the charging station may also be relatively slow in relation to the desired speed with which such displacement may be desired.

Accordingly, it would be advantageous have a relatively flexible handling system which could offer the operator the choice between a motorized displacement and a manual displacement of the winch assembly. The speed of displacement, in the case of a manual displacement, may be higher than the speed that is possible under influence of the motor function.

It is also known to have a winch assembly which does not have a trolley motor or the like for displacing the winch assembly along the a rail. In this case, since the winch assembly is not associated with a trolley motor, the winch assembly must be manually dragged from one point on the rail to another, i.e. to a recharge station.

Thus, from the above it may be appreciated that at present, it is known to provide, a person transport system which has a winch assembly which is displaceable horizontally along a support either manually or under the influence of an (electric) motor (but not both).

It would be advantageous to be able to have a single winch system which could provide both a motorized as well as non motorized displacement function i.e. to allow for a motorized displacement of the winch system along the carriage track or rail or, if desired, a manual displacement of the winch assembly along the carriage track. Such a winch assembly would have a beneficial effect in relation to production as well as storage since it would no longer be necessary to supply two distinct types of winch assemblies i.e. one with a motorized function and one with a manual function. A dual function system as described would thus facilitate production and storage since a single type of assembly could be used in either circumstances depending upon the desires of the user, i.e. only one type of assembly need be made.

In any event, it would be advantageous to have a mechanism whereby the motor and/or the mechanism which induces displacement of the winch assembly may be decoupled from the carriage track i.e. for example for the electric motor to be decoupled from drive wheels which induced displacement of the winch assembly along the rail. In this latter case, it would be advantageous to have a clutch system which would provide an engagement state whereby the motor would induce such displacement along the rail and a non engagement state which would allow manual displacement of the winch assembly along the rail. It would also be advantageous to have a simple quick mechanism which could bring about such coupling and decoupling.

STATEMENT OF INVENTION

In accordance with an aspect the present invention provides a carriage assembly comprising a) a carriage component, said carriage component being configured for coupling to a carriage track of an overhead support for displacement thereof along said carriage track and b) a displacement component for inducing displacement of said carriage component along said carriage track, said displacement component comprising an electric motor element and a clutch coupling element said electric motor element being configured for providing driving effort for the displacement of said carriage component along said carriage track said clutch coupling element being configured for coupling and de-coupling the driving effort of said electric motor element (i.e. relative to a track or rail) such that when the driving effort of said electric motor element is coupled and said electric motor element is energised said carriage component may be urged along said carriage track by said electric motor element and when the driving effort of said electric motor element is de-coupled said carriage component may be manually displaced along said carriage track.

The present invention in particular provides a carriage assembly comprising a) a carriage component, said carriage component being configured for coupling to a carriage track of an overhead support for displacement thereof along said carriage track and b) a displacement component for inducing displacement of said carriage component along said carriage track, said displacement component comprising an electric motor element and a clutch coupling element said clutch coupling element being configured for coupling and de-coupling said electric motor element and said carriage component such that when said electric motor element and said carriage component are coupled and said electric motor element is energised said carriage component may be urged along said carriage track by said electric motor element and when said electric motor element and said carriage component are de-coupled said carriage component may be manually displaced along said carriage track.

In accordance with the present invention a carriage assembly may further include means for connecting said carriage component to a second support track disposed transversely to said carriage track.

In accordance with another aspect the present invention provides a load handling system or assembly (e.g. a person handling system or assembly) comprising a) an overhead support component comprising a carriage track (or rail)

b) a carriage component coupled to said carriage track for displacement thereof along said carriage track c) a person lowering and raising winch component attached to said carriage component and d) a displacement component for inducing displacement of said carriage component along said carriage track, said displacement component comprising a clutch coupling element and an electric motor element said electric motor element being configured for providing driving effort for the displacement of said carriage component along said carriage track said clutch coupling element being configured for coupling and de-coupling the driving effort of said electric motor element (i.e. relative to a track or rail) such that when the driving effort of said electric motor element is coupled and said electric motor element is energised said carriage component may be urged along said carriage track by said electric motor element and when the driving effort of said electric motor element is de-coupled said carriage component may be manually displaced (e.g. hand dragged) along said carriage track.

The present invention in particular provides a load handling system or assembly (e.g. a person handling system or assembly) comprising a) an overhead support component comprising a carriage track (or rail)

b) a carriage component coupled to said carriage track for displacement thereof along said carriage track c) a person lowering and raising winch component attached to said carriage component and d) a displacement component for inducing displacement of said carriage component along said carriage track or rail, said displacement component comprising an electric motor element and a clutch coupling element said clutch coupling element being configured for coupling and de-coupling said electric motor element and said carriage component such that when said electric motor and said carriage component are coupled and said motor is energised said carriage component may be urged along said carriage track by said motor and when said electric motor and said carriage component are de-coupled said carriage component may be manually displaced (e.g. hand dragged) along said track.

In accordance with the present invention a person handling system as described herein may for example further comprise rechargeable battery means for energising the motor and battery recharge station means. A person handling system as described herein may, for example, comprise means for automatically bringing the rechargeable battery means into electrical connection with the battery recharge station. Alternatively, instead of a battery energisable system, the motor(s) and the like may if desired be connected directly to a power outlet means (e.g. wall electrical outlet) by any suitable electrical connection mechanism (e.g. sliding contact(s), coiled electrical leads or wires, etc.). A system may of course be a hybrid system comprising one or more battery energisable elements and one or more directly connected energisable elements In accordance with a further aspect the present invention provides a winch assembly comprising a) a person lowering and raising winch component attached to a carriage component, said carriage component being configured for coupling to a carriage track of an overhead support for displacement thereof along said carriage track and b) a displacement component for inducing displacement of said carriage component along said carriage track, said displacement component comprising an electric motor element and a clutch coupling element said electric motor element being configured for providing driving effort for the displacement of said carriage component along said carriage track said clutch coupling element being configured for coupling and de-coupling the driving effort of said electric motor element (i.e. relative to a track or rail) such that when the driving effort of said electric motor element is coupled and said electric motor element is energised said carriage component may be urged along said carriage track by said electric motor element and when the driving effort of said electric motor element is de-coupled said carriage component may be manually displaced along said carriage track. said electric motor element and when the driving effort of said electric motor element is de-coupled said carriage component may be manually displaced along said carriage track.

In accordance with the above further aspect the present invention in particular provides a winch assembly comprising a) a person lowering and raising winch component attached to a carriage component, said carriage component being configured for coupling to a track of an overhead support for displacement thereof along said track and b) a displacement component for inducing displacement of said carriage component along said track or rail, said displacement component comprising an electric motor element and a clutch coupling element said clutch coupling element being configured for coupling and de-coupling said electric motor and said carriage component such that when said electric motor and said carriage component are coupled and said motor is energised said carriage component may be urged along said track by said motor and when said electric motor and said carriage component are de-coupled said trolley component may be manually displaced along said track.

In accordance with the present invention an assembly as described herein may further comprise rechargeable battery means for energising the motor.

In an additional aspect the present invention provides a kit comprising a) an overhead support component comprising at least a carriage track and b) an assembly as defined herein (i.e. a winch or carriage assembly).

In accordance with the present invention a kit as described herein may further comprise rechargeable battery means for energising the electrical motor element and battery recharge station means. A kit in accordance with the present invention may of course comprise one or more other elements, components, members, etc. as discussed herein In an additional aspect the present invention provides a person handling system comprising a) an overhead support component comprising a carriage track and two spaced apart secondary tracks disposed transversely with respect to said carriage track, b) a first carriage component coupled to said carriage track for displacement thereof along said carriage track c) second and third carriage components, each of said second and third carriage components being coupled to a respective secondary track for displacement thereof along said respective secondary track, said carriage track being attached to said second and third carriage components d) a person lowering and raising winch component attached to said first carriage component e) a first displacement component for inducing displacement of said first carriage component along said carriage track, f) a second displacement component for inducing displacement of one of said second and third carriage components along said respective secondary track, each of said displacement components comprising a respective clutch coupling element and a respective electric motor element each of said respective electric motor elements being configured for providing driving effort for the displacement of a respective carriage component along a respective track each of said respective clutch coupling elements being configured for coupling and de-coupling the driving effort of a respective electric motor element (i.e. relative to a track or rail) such that when the driving effort of said respective electric motor element is coupled and said respective electric motor element is energised said respective carriage component may be urged along said respective track by said respective electric motor element and When the driving effort of said respective electric motor element is de-coupled said respective carriage component may be mutually displaced along said carriage track.

The present invention in particular provides a person handling system comprising a) an overhead support component comprising a carriage track and two spaced apart secondary tracks disposed transversely with respect to said carriage track, b) a first carriage component coupled to said carriage track for displacement thereof along said carriage track c) second and third carriage components, each of said second and third carriage components being coupled to a respective secondary track for displacement thereof along said respective secondary track, said carriage track being attached to said second and third carriage components d) a person lowering and raising winch component attached to said first carriage component e) a first displacement component for inducing displacement of said first carriage component along said carriage track, f) a second displacement component for inducing displacement of one of said second and third carriage components along said respective secondary carriage track, each of said displacement components comprising a respective electric motor element and a respective clutch coupling element each of said respective clutch coupling elements being configured for coupling and de-coupling a respective electric motor element and a respective carriage component such that when said respective electric motor element and said respective carriage component are coupled and said respective electric motor element is energised said respective carriage component may be urged along a respective track by said respective electric motor element and when said respective electric motor element and said respective carriage component are de-coupled said respective carriage component may be manually displaced along said respective track.

The present invention in another aspect provides a person handling system comprising a) an overhead support component comprising a carriage track and two spaced apart secondary tracks disposed transversely with respect to said carriage track, b) a first carriage component coupled to said carriage track for displacement thereof along said carriage track c) second and third carriage components, each of said second and third carriage components being coupled to a respective secondary track for displacement thereof along said respective secondary track, said carriage track being attached to said second and third carriage components d) a person lowering and raising winch component attached to said first carriage component (in this case the winch component may be solely manually displaceable, solely motor displaceable or offer the choice between such displacements as discussed herein)

e) a displacement component for inducing displacement of one of said second and third carriage components along said respective secondary track, said displacement component comprising a clutch coupling element and an electric motor element said electric motor element being configured for providing driving effort for the displacement of said respective carriage component along a respective track said respective clutch coupling element being configured for coupling and de-coupling the driving effort of said electric motor element such that when the driving effort of said electric motor element is coupled and said electric motor element is energised said respective carriage component may be urged along said respective track by said electric motor element and when the driving effort of said electric motor element is de-coupled said respective carriage component may be manually displaced along said respective track.

The present invention in particular provides a person handling system comprising a) an overhead support component comprising a carriage track and two spaced apart secondary tracks disposed transversely with respect to said carriage track, b) a first carriage component coupled to said carriage track for displacement thereof along said carriage track c) second and third carriage components, each of said second and third carriage components being coupled to a respective secondary track for displacement thereof along said respective secondary track, said carriage track being attached to said second and third carriage components d) a person lowering and raising winch component attached to said first carriage component (in this case also the winch component may be solely manually displaceable, solely motor displaceable or offer the choice between such displacements as discussed herein)

e) displacement component for inducing displacement of one of said second and third carriage components along said respective secondary carriage track, said displacement component comprising an electric motor element and a clutch coupling element said clutch coupling element being configured for coupling and de-coupling said electric motor element and a respective carriage component such that when said electric motor element and said respective carriage component are coupled and said electric motor element is energised said respective carriage component may be urged along a respective track by said electric motor element and when said electric motor element and said respective carriage component are de-coupled said respective carriage component may be manually displaced along the carriage track.

An overhead support component may take on any desired or necessary configuration. The overhead support component may for example comprise one or more track or rail elements held in place adjacent a ceiling by any suitable support means such as for example support poles which at their distal end engages a floor; the support means may alternatively take the form of bracket means attached to the ceiling on the on hand and to the track or rail on the other.

The overhead support component and the carriage component may be configured such that said carriage component engages said track such that the carriage component is able to roll, slide glide or be otherwise displaced along said track.

A carriage or trolley component may take on any suitable form which allows it to be supported by and glide or be displaced along a track element, i.e. such that a carriage or trolley component may be moved manually along the track or may be so moved by providing a suitable motorised trolley or carriage displacement system. The carriage or trolley component may comprise a wheeled carriage, i.e. a carriage component may comprise a wheel element. Alternatively the carriage component need not be wheeled, i.e. it may comprise sliding members of a more or less frictionless material such as of TEFLON.

A clutch coupling element of the carriage displacement component, may take any desired or necessary configuration keeping in mind its intended purpose, i.e. to be able to control (i.e. turn on or off) the application of the transfer of a driving effort from the motor element for the displacement of the carriage component relative to the carriage rail or track; for example, for turning on or off the application of the transfer of a driving effort from the motor element to the wheel(s) of a carriage component. Thus the clutch coupling element may be configured in any suitable manner whereby the clutch coupling element is able to couple and de-couple the electric motor and any type of driven member forming part of the clutch coupling element. The driven member for its part is of course to be configured to induce displacement of the carriage component along the carriage support rail or track. The driven member itself may be coupled, for example, directly to the carriage component (i.e. to a wheel thereof) or be indirectly coupled thereto in any suitable manner (e.g. via the rail or track itself). The clutch coupling element may be configured in any suitable manner such as for example as specifically discussed herein (including any mechanical equivalent thereof) The clutch component may for example comprise a pair of gear elements which may as desired be engaged or disengaged as the case may be. The gear elements may take any desired or necessary form keeping the above in mind. Example of various types of clutches are described in the following patents; these may be configured as necessary or desired for exploitation in the context of the present invention; see U.S. Pat. Nos. 6,085,368 4,458,795 3,721,324 3,643,770 2,905,294 2,024,947 and 1,951,139 (the entire contents of each of which is incorporated herein by reference).

In accordance with another aspect the present invention in particular provides a coupling/de-coupling clutch mechanism or assembly (e.g. reversible mechanism) which may for example, comprise

- a drive shaft able to be (i.e. configured to be) rotated in a first direction and, if so desired or necessary, in a second opposite direction (e.g. rotation being induced by an electric motor to which the drive is directly or indirectly coupled)
- a rotatable driving member coupled to said drive shaft such that rotation of the drive shaft induces (a like) rotation of the rotatable driving member
- a rotatable driven member (e.g. coupled to a wheel element) for urging a carriage component along a track
- a clutch member for coupling (i.e. engaging) and decoupling (i.e. disengaging) said driving member with said driven member
- in response to rotation of said drive shaft (i.e. in said one first direction and/or said second direction)
- said clutch member being configured to couple said driving member with said driven member for urging the driven member to rotate in.said first direction for urging said respective carriage component along said carriage track and, if so desired or necessary, said clutch component being further configured to couple said driving member with said driven member for urging the driven member to rotate in said second direction opposite to said first direction for urging said carriage component in an opposite direction along said carriage track. The clutch mechanism may comprise means for engaging and disengaging said clutch member in response to rotation of said drive shaft.

A clutch mechanism in accordance with the present invention may for example comprise

- a first clutch component configured to couple said driving member with said driven member for urging the driven member to rotate in one direction
- a second clutch component configured to couple said driving member with said driven member for urging the driven member to rotate in a second direction opposite to said one direction
- a means for engaging said first clutch and disengaging said second clutch in response to rotation of said drive shaft in said one direction and
- a means for engaging said second clutch and disengaging said first clutch in response to rotation of said drive shaft in said second direction.

The above first and second clutch components may for example be comprised in a single component such as, for example, a shuttle component as described herein; the first and second clutch components may of course take any other (suitable, desired or known) form keeping in mind the function thereof.

In accordance with the present invention the driving member and the driven member may be disposed coaxially relative to the axis of rotation of the drive shaft.

In accordance with the present invention the rotatable driven member may define an annular or ring member. The annular or ring member may be provided with any suitable engagement means or elements; such engagement means may take the form, for example, of internally extending sprocket or gear teeth or alternatively, a plurality of perforations configured for engagement with engagement means or elements of the shuttle component as shall be discussed herein In accordance with the present invention the rotatable driving member may define a slot (or the like) extending transversely (i.e. radially) to the axis of rotation of the drive shaft. The slot may accommodate a shuttle component which slidingly en gages the wall elements of the driving member defining the slot such that the shuttle component is able to be displaced to and fro in the slot transversely to the axis of rotation of the drive shaft; the shuttle component is in any event engaged or mounted in the slot such that rotation of the driving member induces a like rotation of the shuttle component.

The opposed ends of the shuttle component may be provided with any suitable (corresponding) engagement means configured for mating engagement or meshing with the engagement means or elements of the abovementioned annular or ring member; such engagement means may take the form for example of corresponding externally or outwardly extending sprocket or gear teeth for mating engagement or meshing with the internally or inwardly extending sprocket or gear teeth of the ring member.

The shuttle component as described herein may, for example, comprise a single unitary member; alternatively a shuttle component may for example comprise a pair of separate (opposed) slide members. The shuttle component (as well as the displacement element or member mentioned below) may be configured such that displacement of the shuttle component for engagement with the annular or ring member may be such as to provide a reversible type of driving effort (i.e. a driving effort alternatively in either the first or the second rotational direction) or a unidirectional driving effort (i.e. a driving effort in one (e.g. rotational) direction).

In accordance with the present invention the means for engaging and disengaging the clutch may for example comprise a displacement element or member mounted on the drive shaft. The displacement element or member may, for example be configured to engage a projection extending axially from the shuttle component so as to induce displacement of the shuttle in the slot of the driving member in response to a rotational movement of said drive shaft. In other words, the displacement element or member may be configured so that in response to a rotational movement of the drive shaft, the displacement element or member is able to engage the shuttle component so as to induce the shuttle component to alternately extend from and/or retract into said slot and thus into engagement or disengagement with the annular or ring member (e.g. by the intermeshing of gear teeth). In accordance with the present invention means may be provided with a winch assembly which may be configured such that when motorised movement of the carriage is no longer desired the motor may be induced to rotate in the opposite direction for example a quarter (¼) turn so as to bring about disengagement of the shuttle component for manual displacement of the carriage.

As mentioned above, in accordance with the present invention the electric motor and the driven member (i.e. the member coupled for example to the wheels of a trolley or carriage as described herein) may be coupled such that when the motor is energised the carriage may be displaced along a track.

A winch assembly (i.e. comprising the rail movement motor, the rail movement clutch coupling component, etc.) may, for example, be appropriately configured in any suitable (known) manner such that the motor induced rotation of the driven member in one direction leads to the movement of the carriage and winch assembly attached thereto in a predetermined direction along as track whereas motor induced rotation of the driven member in the opposite direction leads to movement in the opposite direction; in this case the clutch is of course to be configured for so as to be reversible the driven member.

The motor may be any suitable or desired (known) type of electric motor; if desired, it may be a variable speed motor, a reversible motor, a non-reversible motor, etc. The motor may if desired or as necessary be associated with other mechanical/electrical elements (e.g. gear reduction elements, rotational speed variation means, gear means for changing the direction of rotation of the worm gear drive shaft, etc.).

As mentioned above, a motorized version of the winch assembly may have a trolley or carriage motor suitably connected to provide power to one or more wheel(s) of a trolley carriage for inducing the winch assembly to be urged back and forth along an overhead track or rail system.

Alternatively, the trolley or carriage motor may be connected to a pulley system which is configured to bring about of the same effect i.e. the trolley carriage may include wheels which are not themselves powered. In this case an endless loop may be connected to the trolley carriage truck and to pulleys at either end of the desired rail component with the motor either turning a pulley so as to induce the pulley to cause displacement or to grip the cord and do such displacement.

A rechargeable battery, as mentioned, may be provided for energizing the trolley motor. The system may thus further be associated with a battery recharging station. The motorized system may include a trolley motor control mechanism. The trolley control mechanism may be configured to provide a first function whereby the trolley motor may be activated to displace the trolley component along the rail a desired distance. The trolley control mechanism may as desired also be configured to provide a second (or recharge) function whereby the trolley motor may be activated so as to automatically displace the winch mechanism to a recharging station where the battery may be recharged; the mechanism and the recharge station being provided with suitable corresponding electrical connector means to achieve this purpose; the station being for example connected to an suitable source of electrical power.

In drawings which illustrate example embodiments of the present invention:

FIG. 1 schematically shows a person handling system comprising a single L shaped rail attached to the ceiling of a room when viewed from above the ceiling with the ceiling removed;

FIG. 2 schematically shows another person handling system comprising an X-Y configured rail system attached to the ceiling of a room when viewed from above the ceiling with the ceiling removed;

FIG. 3*a* shows a person handling system having no motor for the horizontal displacement of the winch assembly wherein the person strapped into the transportation harness is displaceable horizontally by manually pushing on the person;

FIG. 3*b* shows a person handling system provided with a trolley motor for the horizontal displacement of the winch assembly wherein the person strapped into the transportation harness is displaceable horizontally by activation of the motor;

FIG. 3*c* shows in schematic fashion the automatic return to a charging station under the influence of the trolley motor;

FIG. 3*d* shows in s more detailed schematic fashion the elements of FIG. 3*c;*

Figure 10:
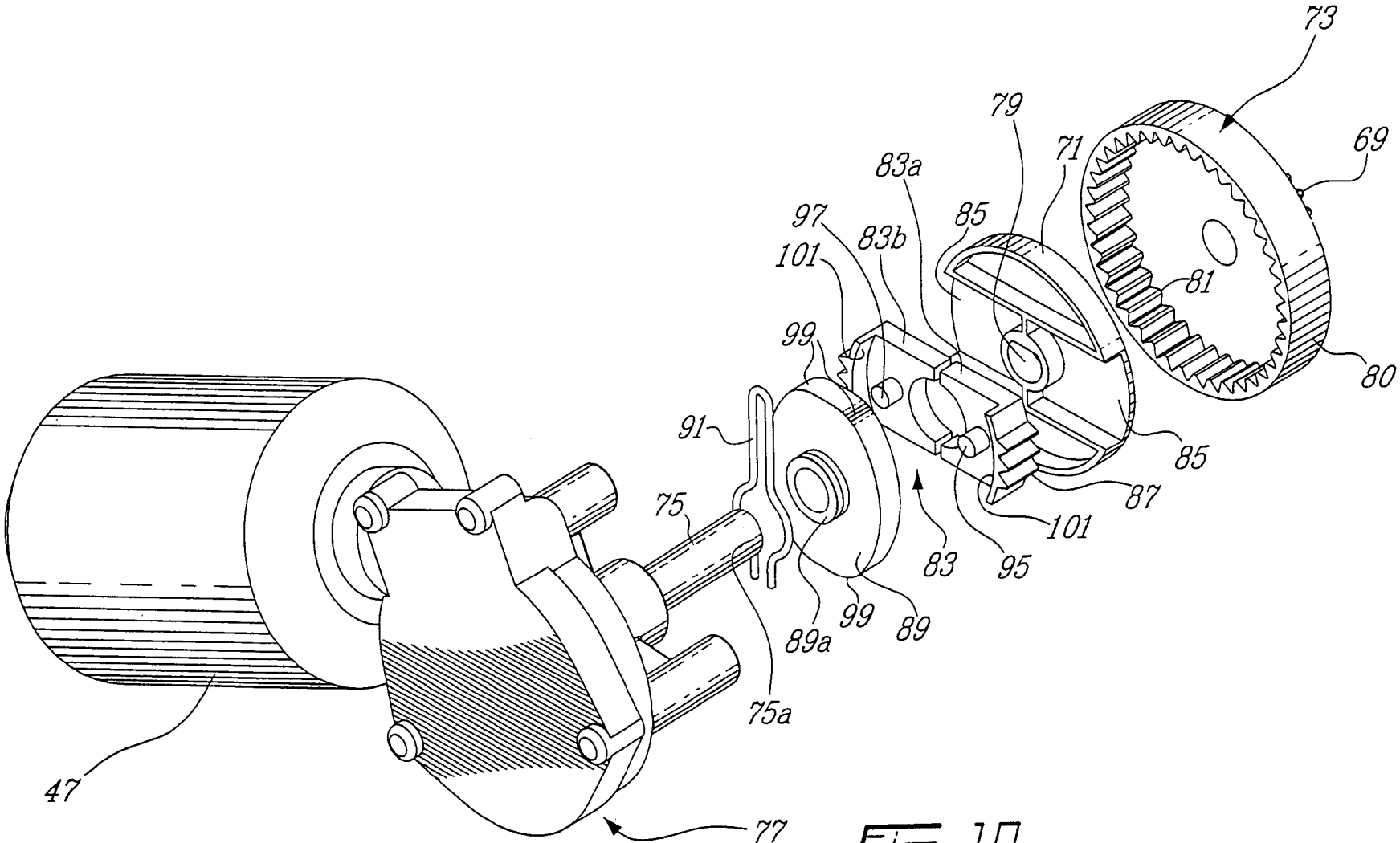
FIG. 10 is an exploded perspective side view of opposite side of the trolley motor and coupling/de-coupling component shown in FIG. 9.
Figure 10A:
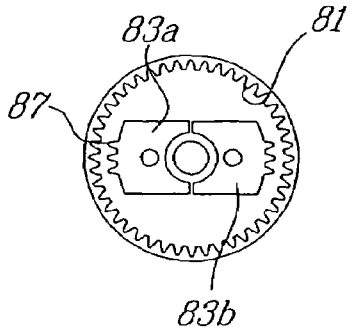
Figure 10B:
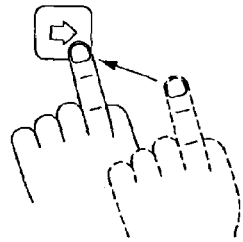
Figure 10C:
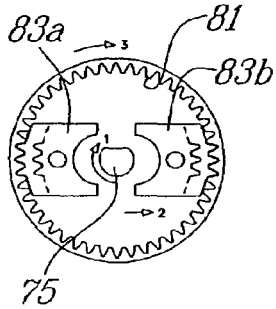
Figure 10D:
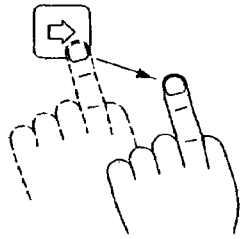
Figure 10E:
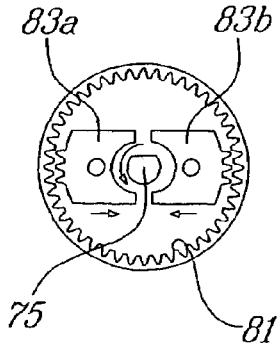
Figure 11A:
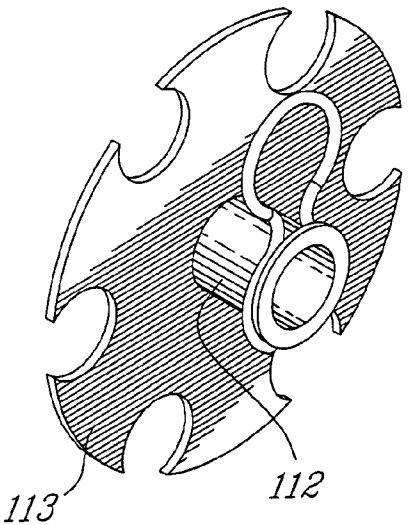
Figure 11:
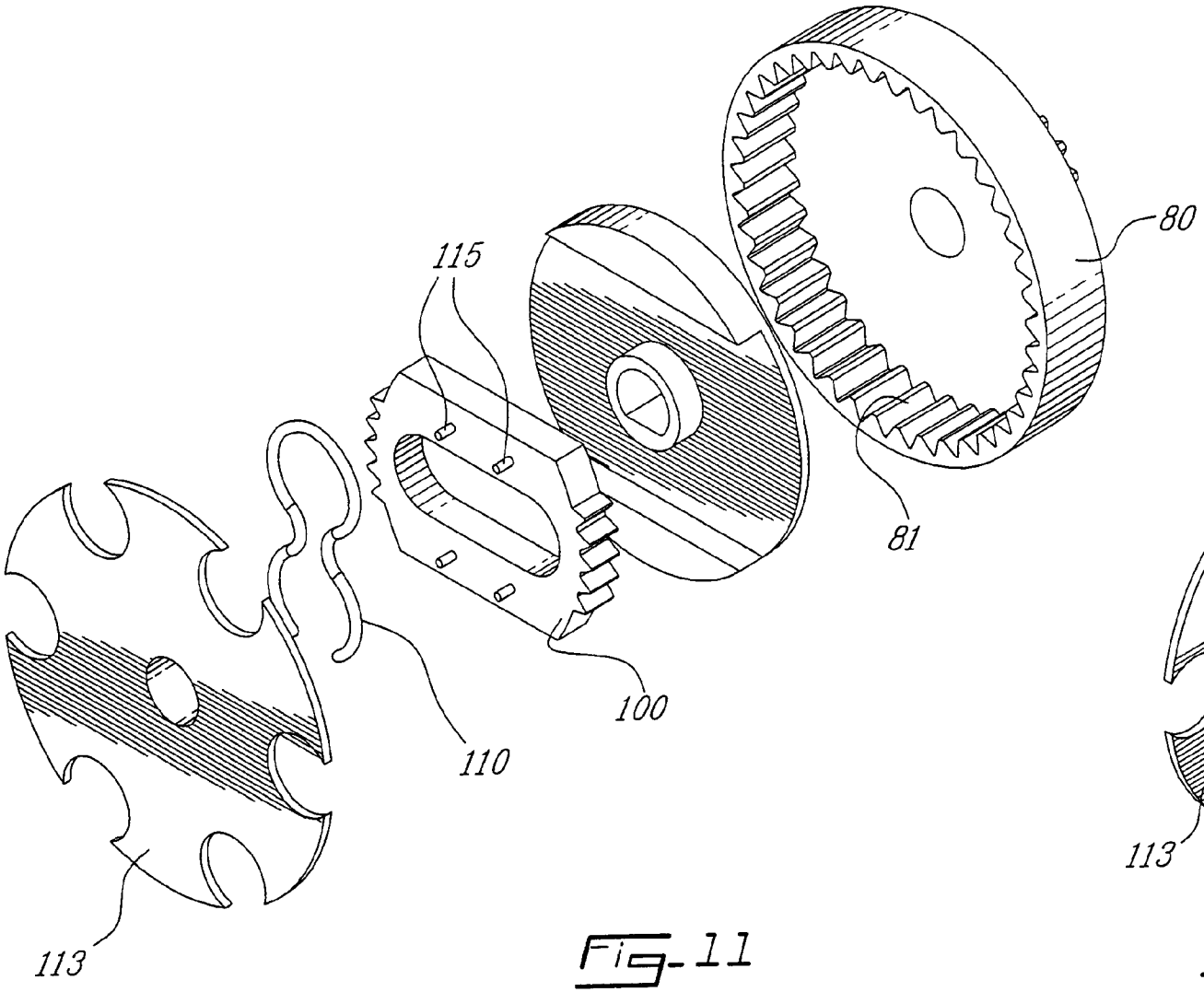
Figure 11B:
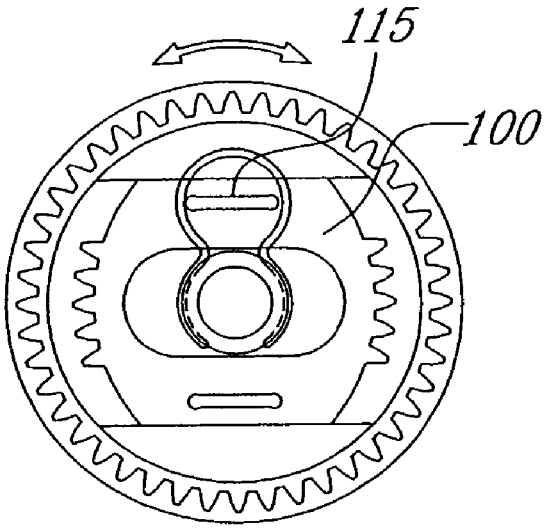
Figure 11C:
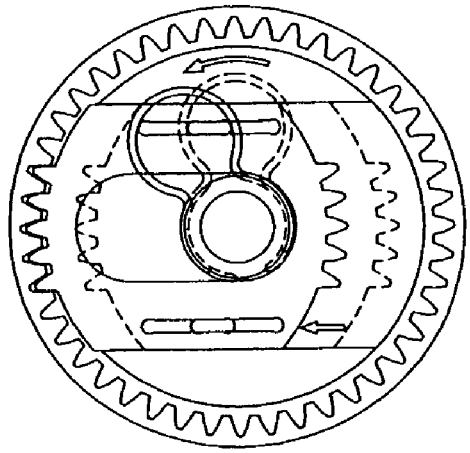
Figure 11D:
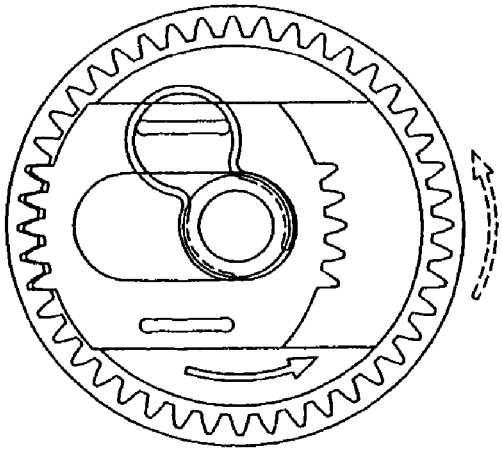

FIGS. 10*a*, 10*b*, 10*c*, 10*d* and 10*e* show in schematic block diagram form the engagement and disengagement of a two part shuttle component, namely FIG. 10*a* showing the shuttle component in free or unengaged position, FIG. 10*b* showing a press and hold button (left or right) for initiating shuttle component engagement, FIG. 10*c* showing shuttle component engagement induced by the motor turning right (or left) so as to move the two shuttle elements into an engagement position whereupon the external wheel will turn, FIG. 10*d* showing release of the press button (i.e. to off), and FIG. 10*e* showing the drive shaft turning in the opposite rotational direction automatically (i.e. as induced by the motor) just enough to release the two shuttle elements from engagement with the teeth of the external wheel;

FIG. 11 is an exploded perspective side view of another example embodiment of a coupling/de-coupling component of the winch assembly;

FIG. 11*a* is a perspective view of the anchor member of the coupling/de-coupling component of FIG. 11;

FIGS. 11*b*, 11*c* and 11*d* illustrate in schematic fashion the functioning of the alternate coupling/de-coupling component shown in FIGS. 11 and 11*a;*

Figure 4:
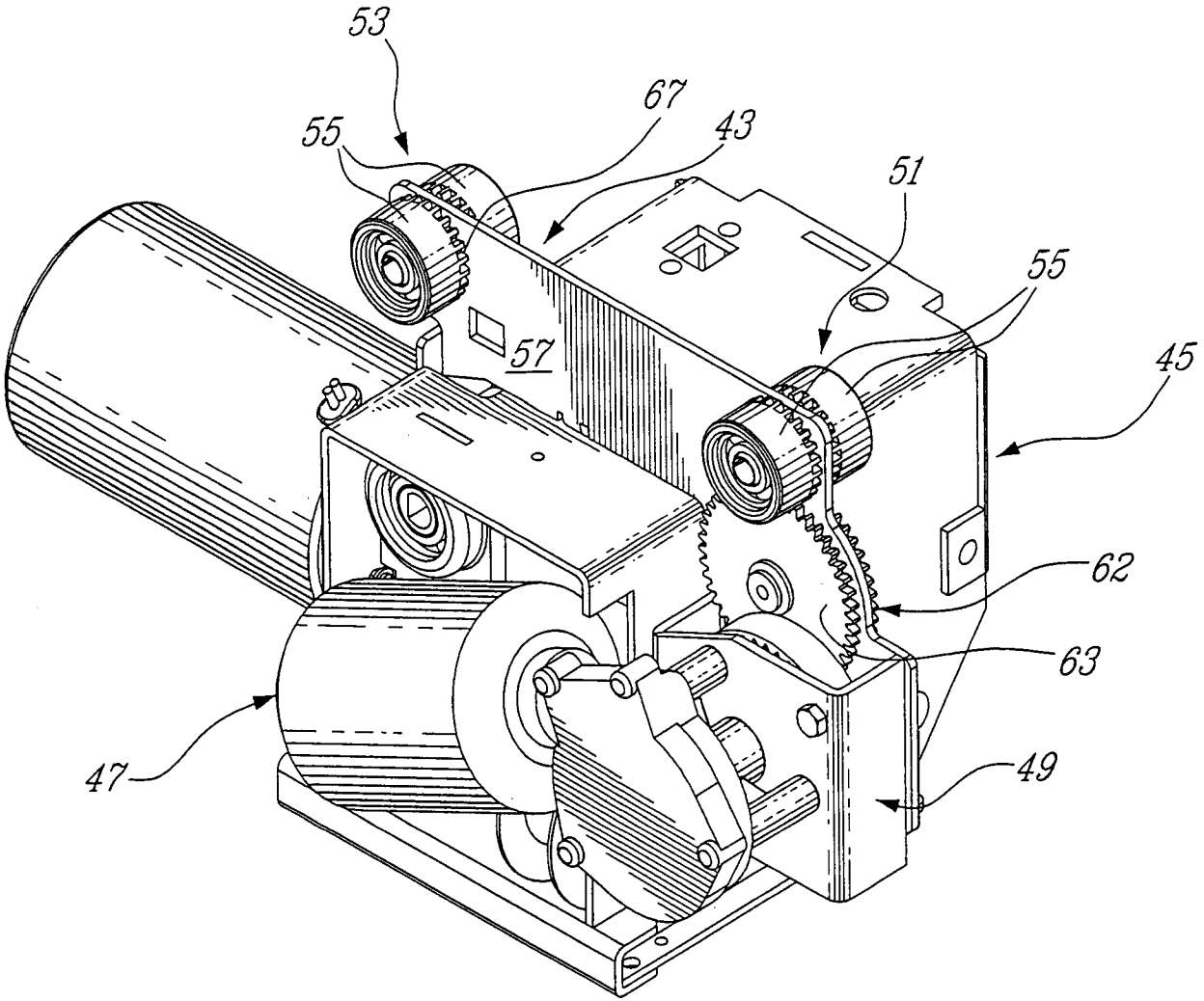
FIG. 4 shows a perspective side view of a winch assembly in accordance with the present invention provided with a trolley motor and trolley carriage.
Figure 12:
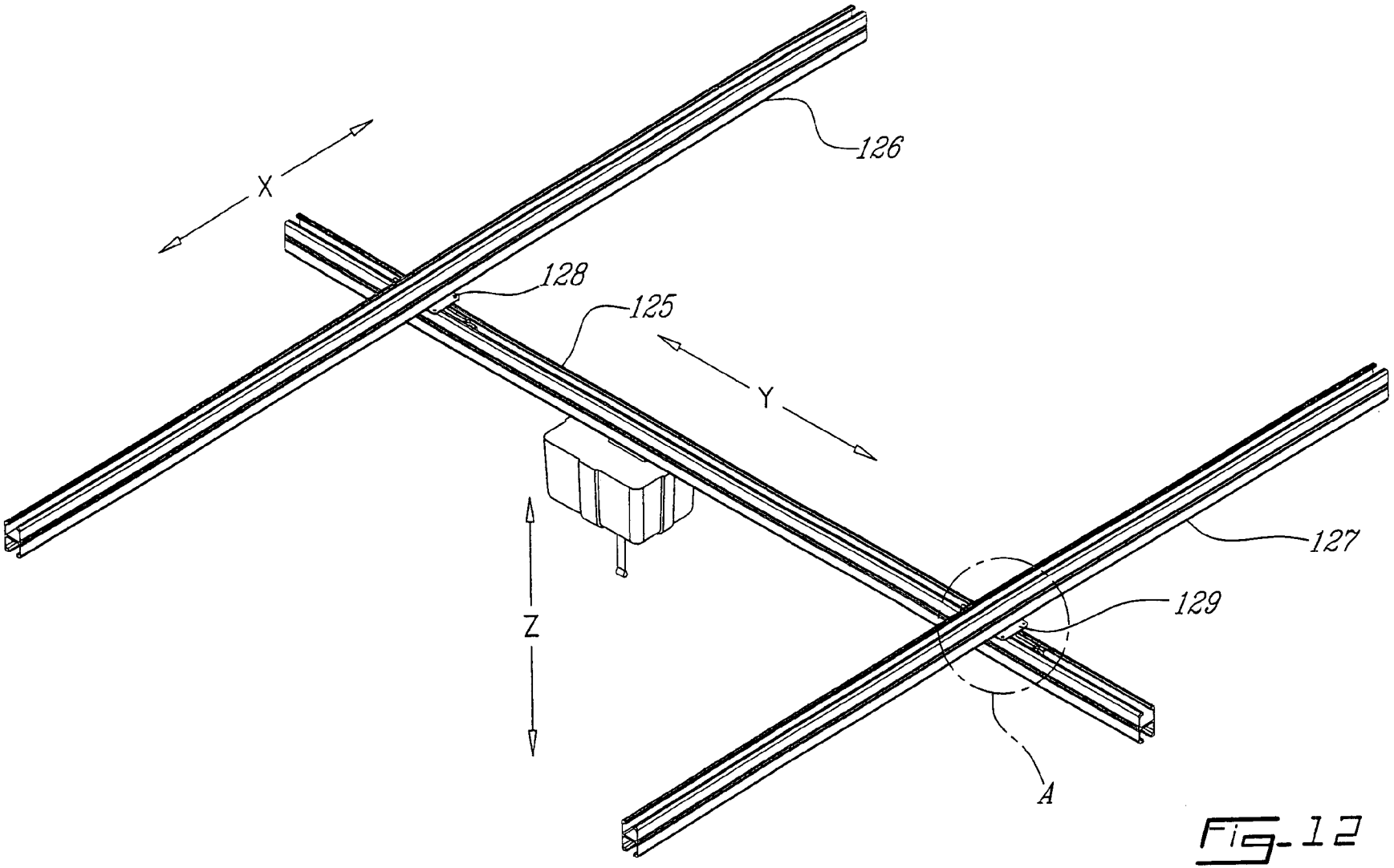
Figure 13:
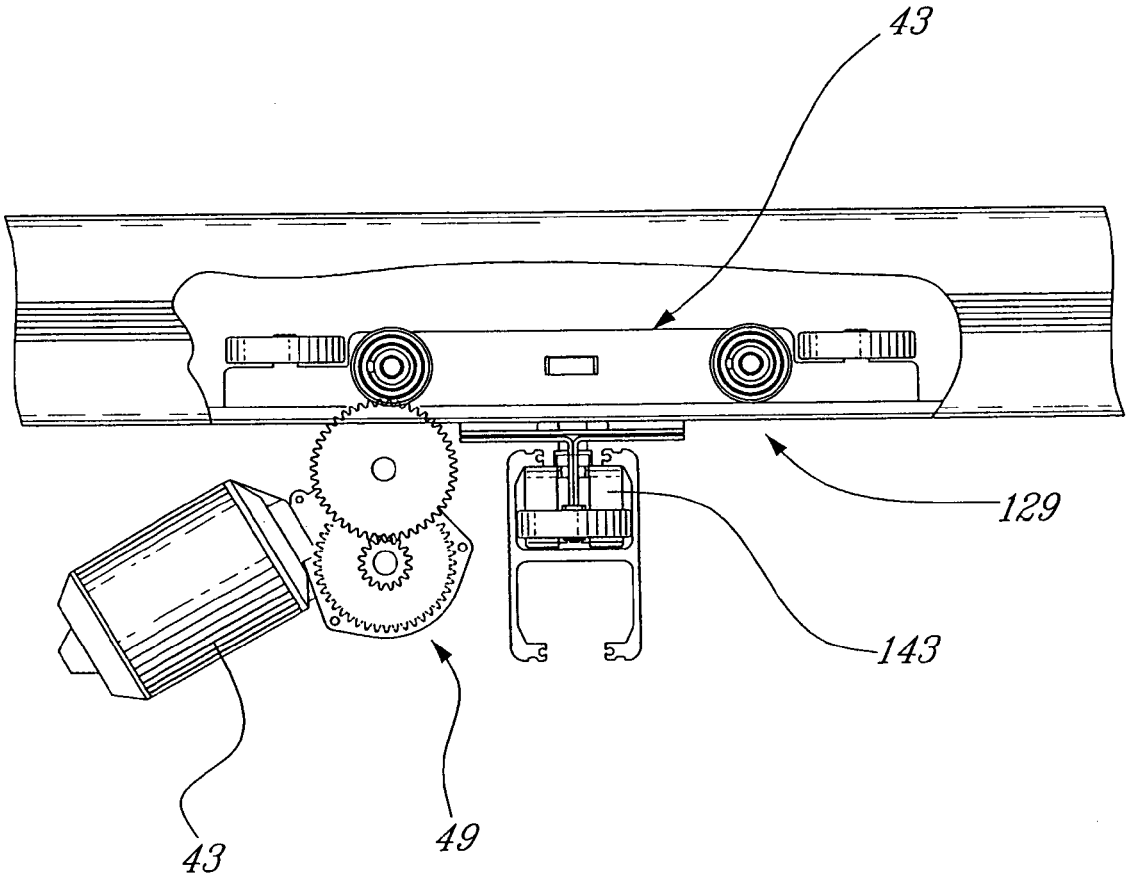
Figures 14, 15:
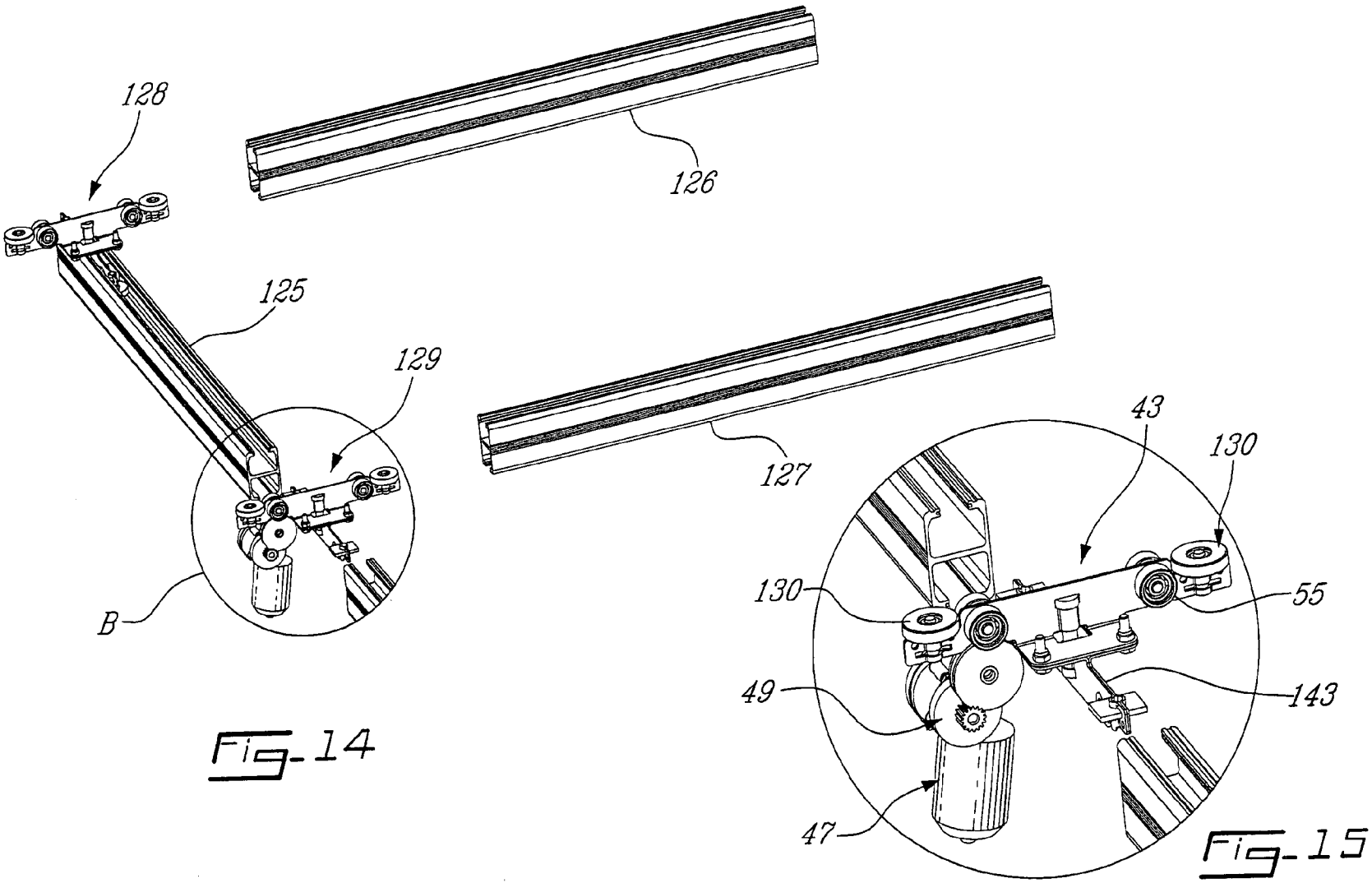
Figure 15B:
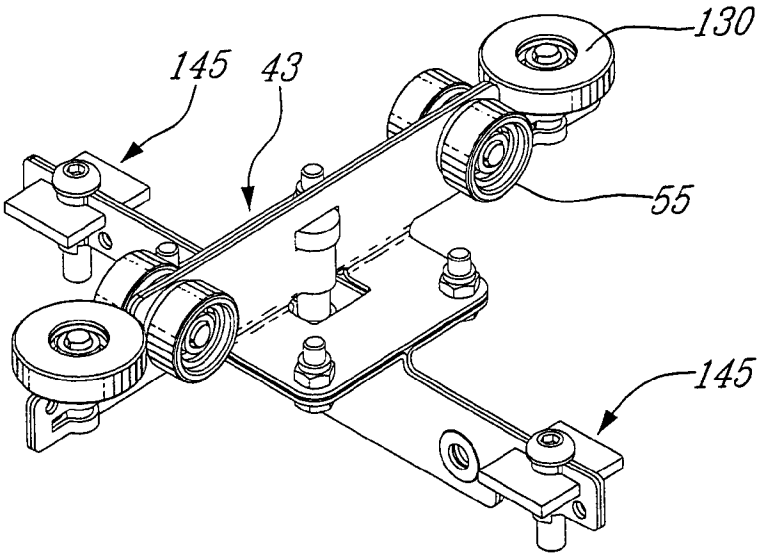
Figure 15A:
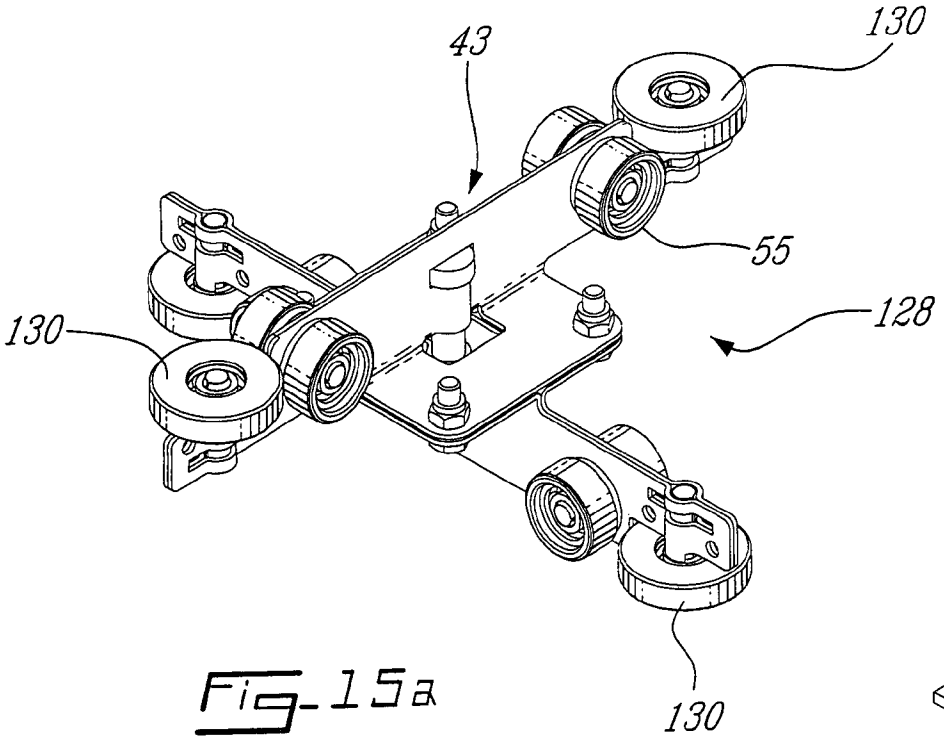
Figure 16:
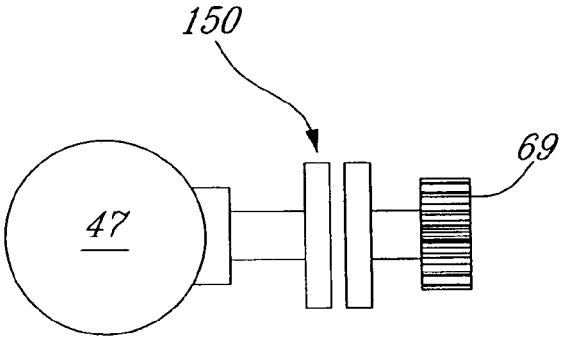
Figure 16A:
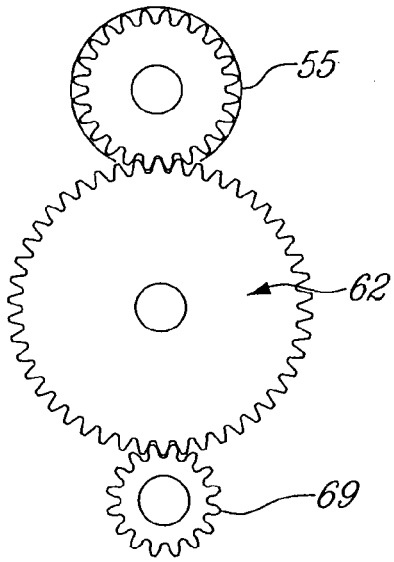
Figure 17A:
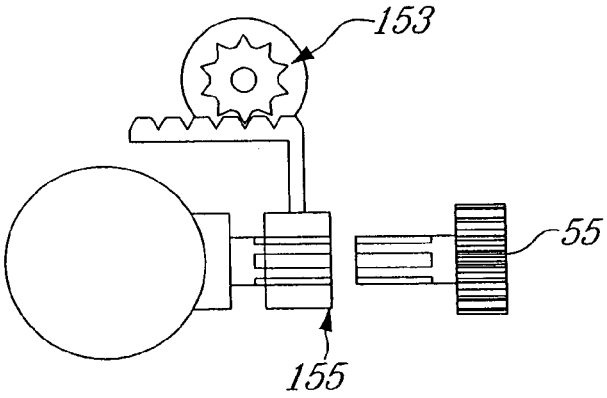
Figure 17B:
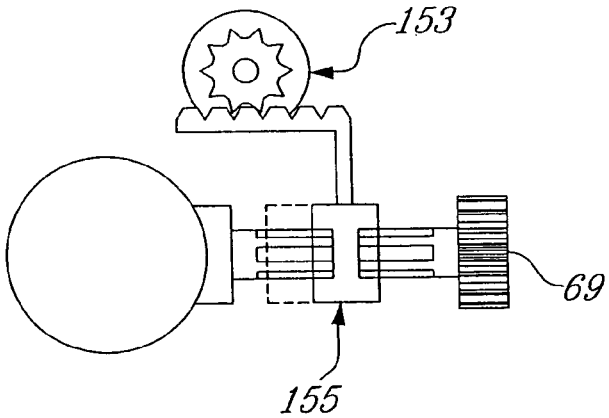
Figure 17C:
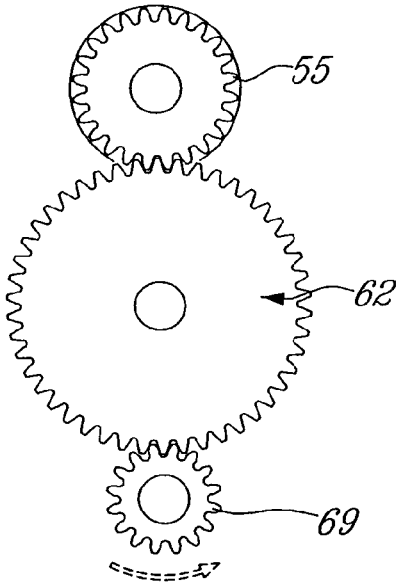
Figure 18:
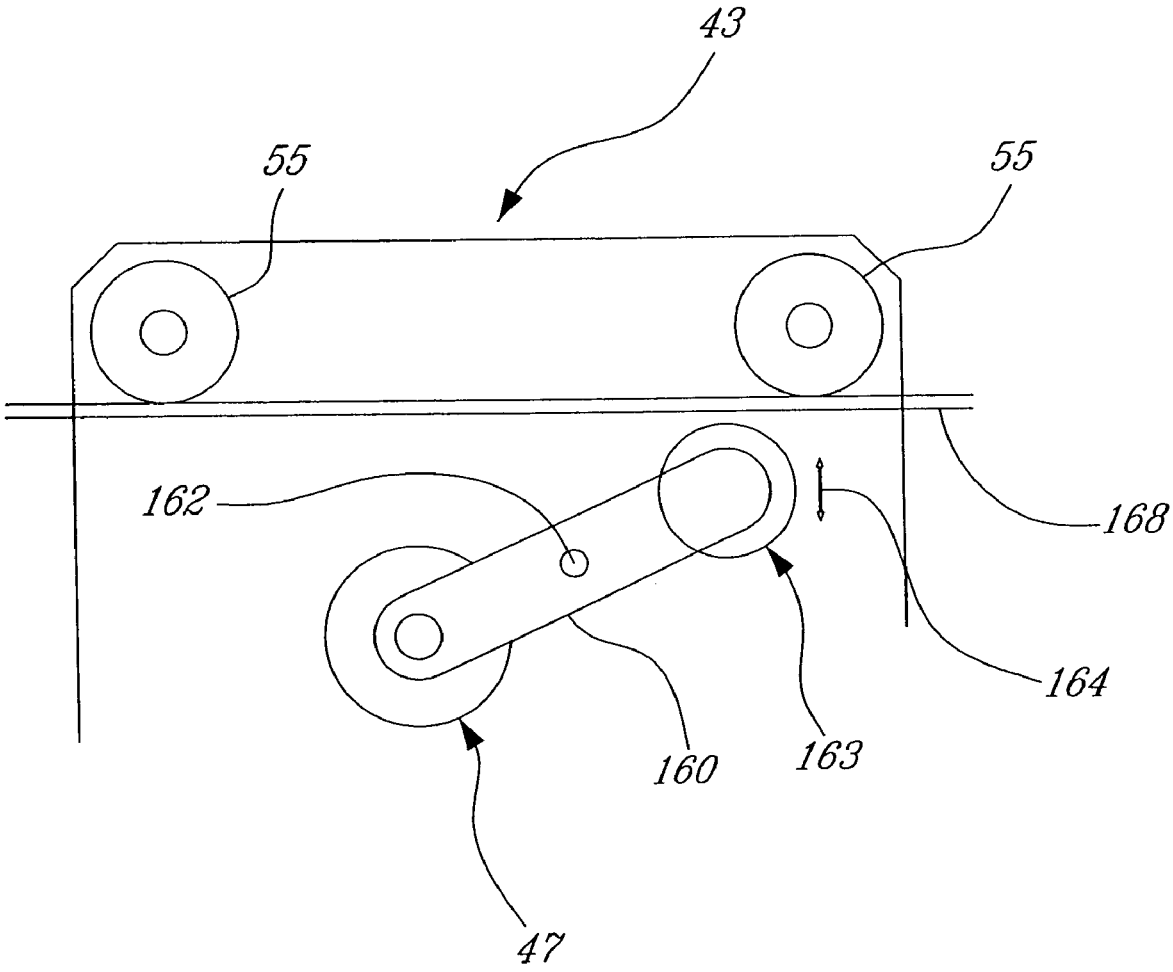
Figure 19B:
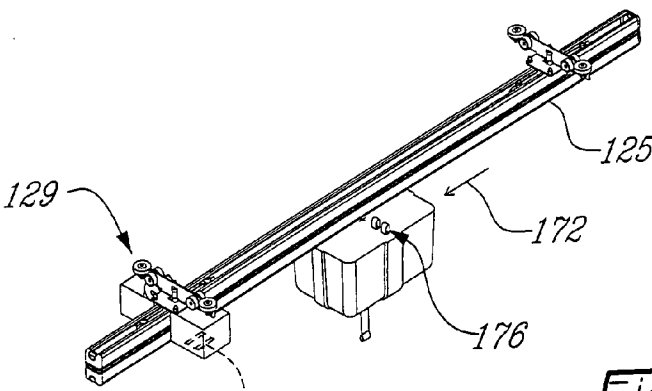
Figure 19D:
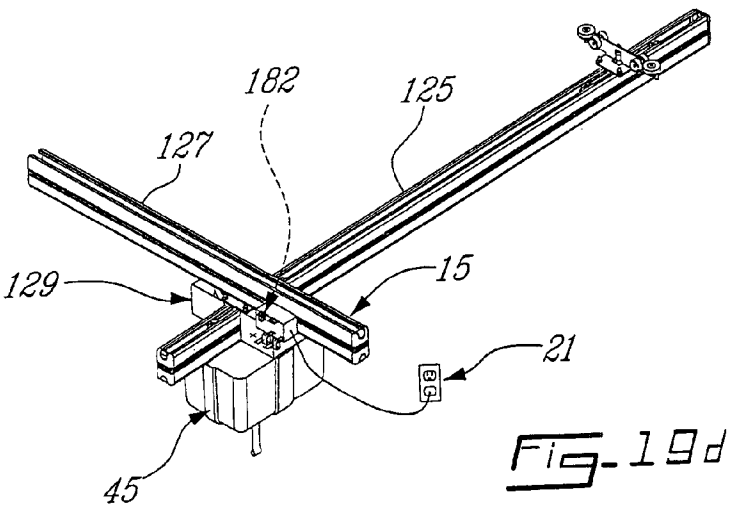
Figure 19A:
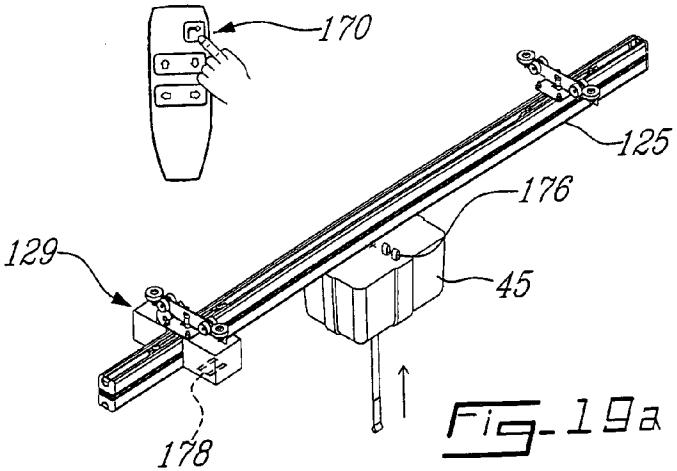
Figure 19C:
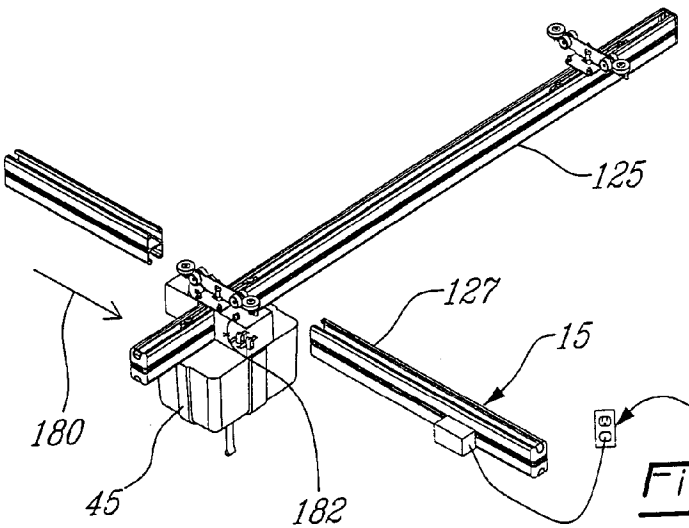

FIG. 12 is a perspective side view of an X-Y rail system wherein the transverse rail element is displaceable by a displacement means comprising a motor and coupling assembly configured in a fashion analogous to that for the winch assembly of FIG. 4;

FIG. 13 is an enlarged partial schematic side view of the displacement means shown in FIG. 12 with the carriage wheels, exposed;

FIG. 14 is a more detailed exploded perspective side view of inter-rail coupling means of the X-Y rail system of FIG. 12 shown at A;

FIG. 15 is an enlarged partial schematic side view of the displacement means shown in FIG. 14 with the web/wheel combination exposed shown at B;

FIG. 15*a* illustrates a schematic perspective side view of an example embodiment of an unmotorised truck or carriage component which maybe used for an X-Y rail system;

FIG. 15*b* illustrates a schematic perspective side view of another example embodiment of an unmotorised truck or carriage component which maybe used for an X-Y rail system FIG. 16 is a schematic illustration of an alternate embodiment of a coupling/de-coupling component;

FIG. 16*a* is a schematic illustration of the interaction between the driven member of the coupling/de-coupling component shown in FIG. 16 and the idler gear linking it to the carriage wheel;

FIG. 17*a* is a schematic illustration of an further example embodiment of a coupling/de-coupling component exploiting a mechanical mechanism, the component being shown in a de-coupled configuration;

FIG. 17*b* is a schematic illustration of the coupling/de-coupling component shown in FIG. 17*a* the component being shown in a coupled configuration;

FIG. 17*c* is a schematic illustration of the interaction between the driven member of the coupling/de-coupling component shown in FIG. 17*a* and the idler gear linking it to the carriage wheel;

FIG. 18 is a schematic illustration of another example embodiment of a coupling/de-coupling component exploiting a friction driving wheel mechanism; and FIGS. 19*a*, 19*b*, 19*c* and 19*d* illustrate in schematic fashion the functioning of an example embodiment of an automatic return to recharge function for an X-Y rail system as described herein (see for example FIG. 12).

In reference to the figures, the same reference numbers will be used to refer to the same elements components.

Figure 1:
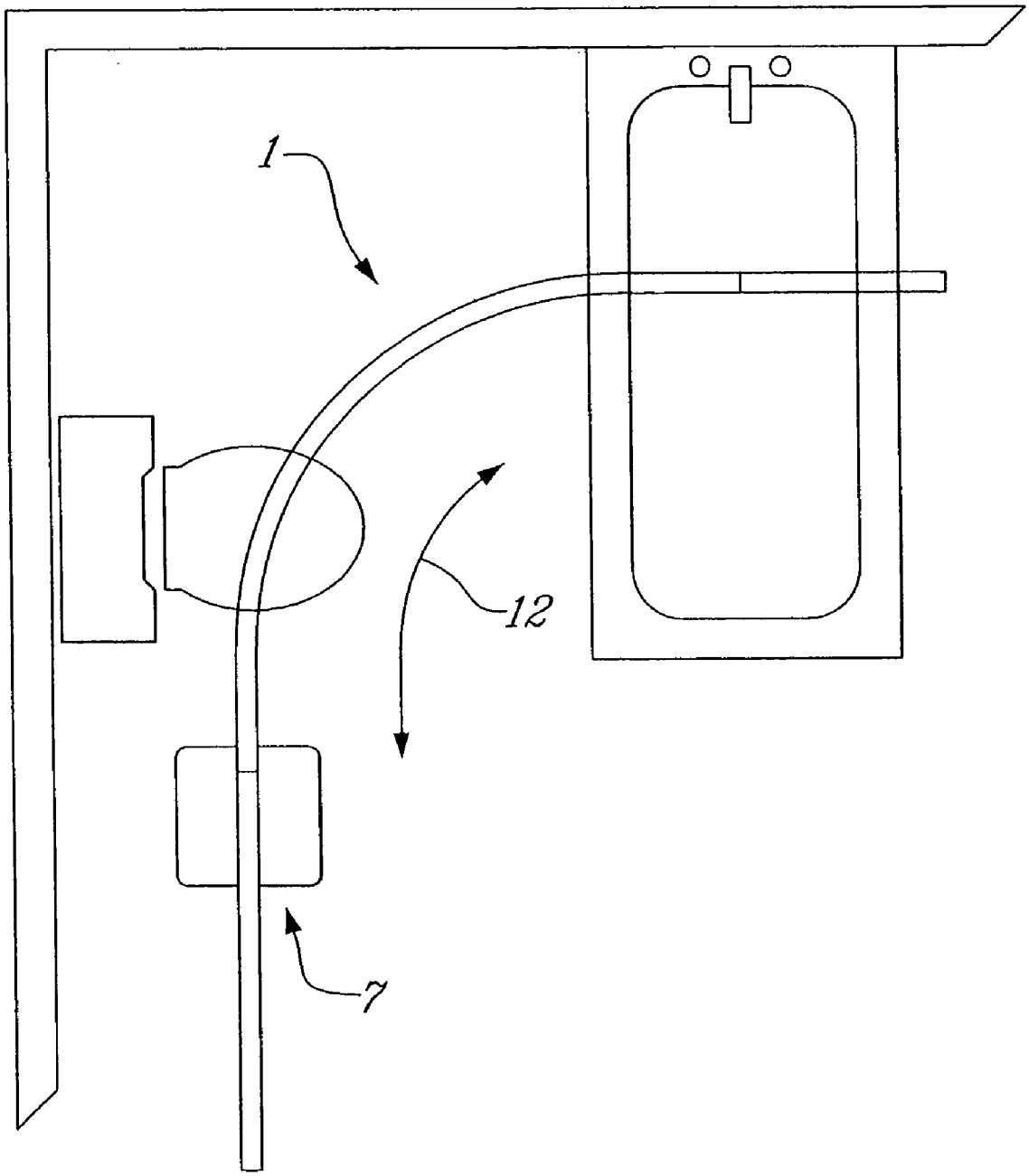

FIG. 1, illustrates a known type of person handling system comprising a single overhead track component 1 which includes a single overhead curved carriage rail (or track) fixed to a ceiling by attachment means (not shown). This known system also features (see FIG. 3*d*) a wheeled carriage 5 attached or connected to a person lowering and raising winch component indicated generally as 7. The overhead track component 1 and the wheeled carriage 5 are configured such that the wheels 9 of the carriage 5 engage the track 1 such that the carriage 5 is able to glide or roll along said track 1 A trolley or carriage drive motor 11 (e.g. electric motor) is coupled to one of the carriage wheels 9 for inducing the wheels of the trolley carriage to cause the entire winch component. 7 to be displaceable from one position to another i.e. (See FIG. 1) from the doorway of the bathroom shown to the toilet seat or to the bath tub and back in the direction of the arrow 12.

Referring back to FIG. 3*d*, the system includes a rechargeable battery 13 for energizing the trolley motor 11. Such a known system may further be associated with a battery recharging station (indicated generally by reference number 15) for recharging not only the trolley battery but also any other battery that may be associated with the system. The recharge station comprises a battery recharger 17 which is electrically coupled by wire 19 to a suitable source of electrical power which as shown is the electric outlet 21; the recharger includes an electrical contact strip 22. The winch element 7 is on the other hand provided with (known) electric contact means 23 which is electrically coupled to the rechargeable battery 13. In order to recharge the battery the winch assembly is displaced until the electric contact means 23 is brought into slipping electrical contact with the electrical contact strip 2.

It is also known to associate with such a motorized person handling system, a trolley motor control mechanism (not shown). The trolley control mechanism is configured in any suitable manner so as to provide a first function whereby the trolley motor 11 may be activated to displace the trolley component along the rail a desired distance (and direction). The trolley control mechanism is also configured to provide a second (or recharge) function whereby the trolley motor may be activated so as to automatically displace the winch element 7 to the recharging station 15 where the battery may be recharged; the trolley control mechanism and the recharge station 15 being provided with suitable corresponding electrical connector means to achieve this purpose such as shown generally in FIG. 3*d*.

Figure 2:
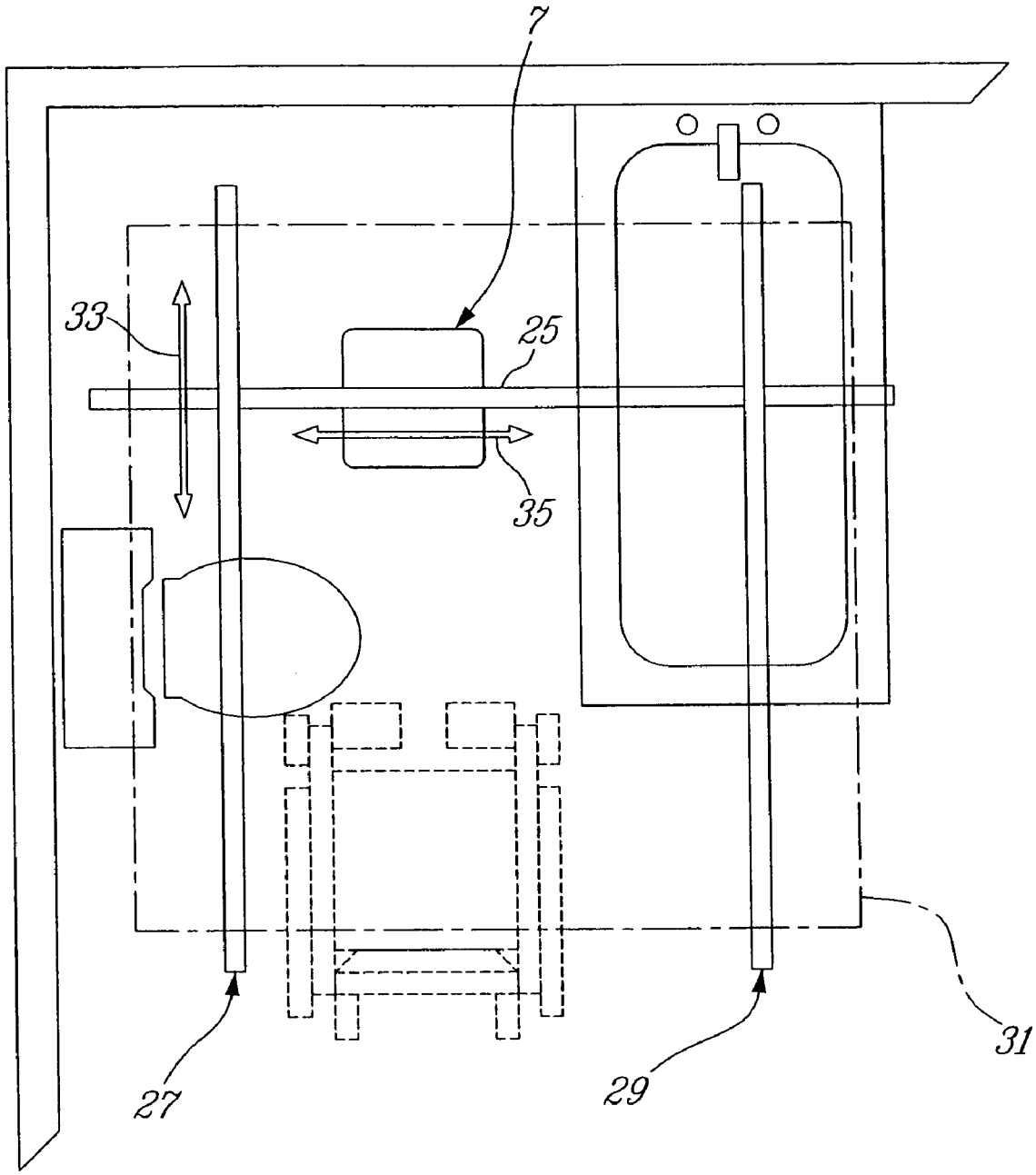

FIG. 2 illustrates what may be considered an X-Y rail system which can provide for a greater degree of movement of a winch assembly about a given work are or room i.e. as compared to the single rail system of FIG. 1. In addition to the winch travel rail 25 (i.e. the carriage track) along which the winch element 7 is able to be displaced, this system includes at least two (parallel) spaced apart rails 27 and 29 which are attached to the ceiling of a room or which are supported at or near the ceiling by suitable support posts (in known manner). The area shown in dotted outline 31 is the area over which the winch element 7 may be displaced. The winch travel rail 25 is transversely attached to each of these parallel rails 27 and 29 by respective wheeled trucks, carriages or by sliding members to allow manual horizontal displacement of the winch travel rail itself back and forth in the direction of the arrow 33 shown (i.e. Y-direction); see for example FIGS. 12 to 15. The displacement of this transverse rail 25 itself in the direction of the arrow 33 provides a second degree of freedom of horizontal movement for the winch assembly shown. The first degree of horizontal freedom of movement of the winch assembly (X-direction) is of course along the transverse rail itself and is induced by the trolley motor (see arrow 35). These two horizontal degrees of freedom of movement are in addition to the vertical degree of movement which involves the displacement (i.e. Z-displacement) of a person who is attached in a harness in the up and down directions (see arrow 37 in FIGS. 3*a*,3*b* and 3*d*).

As mentioned the transverse winch travel rail 25 is configured so that it may be manually pushed in the Y-direction. Alternatively, and in accordance with the present invention, as shall be discussed below (see FIG. 12 to 15), the transverse winch travel rail or beam 25 may have a motorized trolley(ies) or carriage(s) for the motorized displacement of the transverse rail 25.

The person lowering and raising winch element 7 itself (in relation to the systems shown in FIGS. 1 and 2 as well as for the present invention) may in particular comprise a support structure, a flexible elongated support member 39 connected to a harness component 41 (see FIG. 3*d*) for holding a person, a reel component connected to the support structure for winding up and paying out (i.e. unwinding) the flexible elongated support member and a reel electric motor. The reel electric motor may be coupled to the reel component in any suitable (known) fashion such that when the reel motor is energised it may induce the reel component to unwind or wind up the flexible elongated support member, i.e. to vertically raise or lower a person as the case may be. For more details with respect to such a person lowering and raising winch assembly please see for example U.S. Pat. No. 6,085,368, the entire contents of which are incorporated herein by reference.

The disadvantage of the systems shown in FIGS. 1 and 2 is that the displacement of the winch element 7 itself along a rail 25 is motorized and thus subject to a preset displacement speed. In accordance with the present invention the winch element 7 and wheeled carriage may configured such that the winch element 7 may be displaced manually along the carriage support rail or under power from a trolley motor, as desired.

Figure 3B:
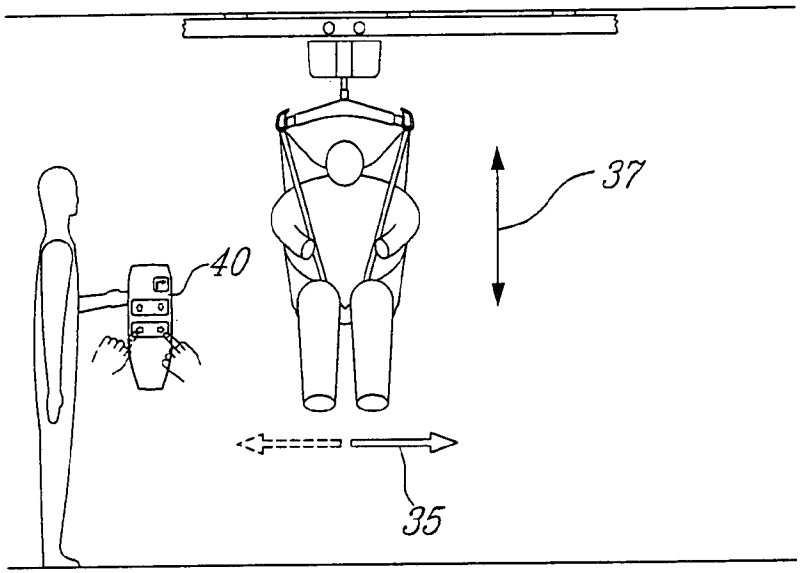
Figure 3A:
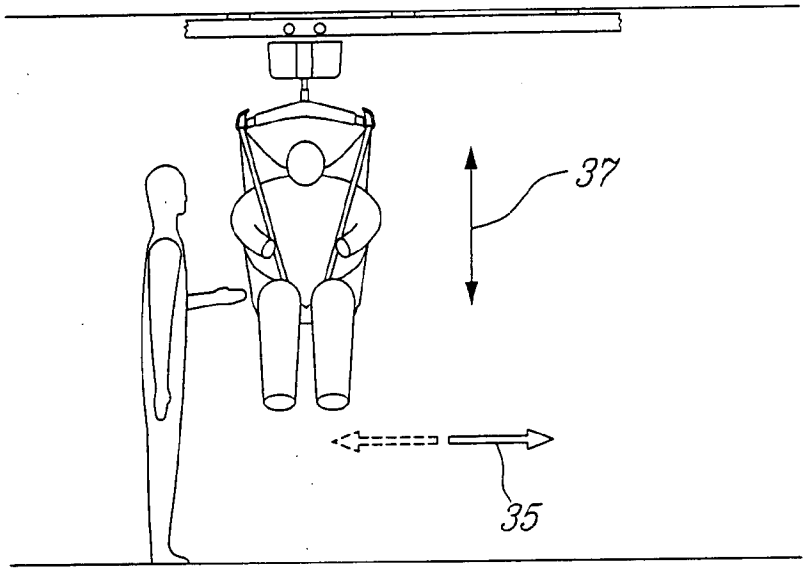
Figure 3C:
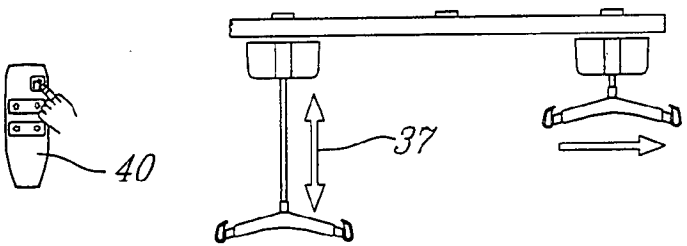
Figure 3D:
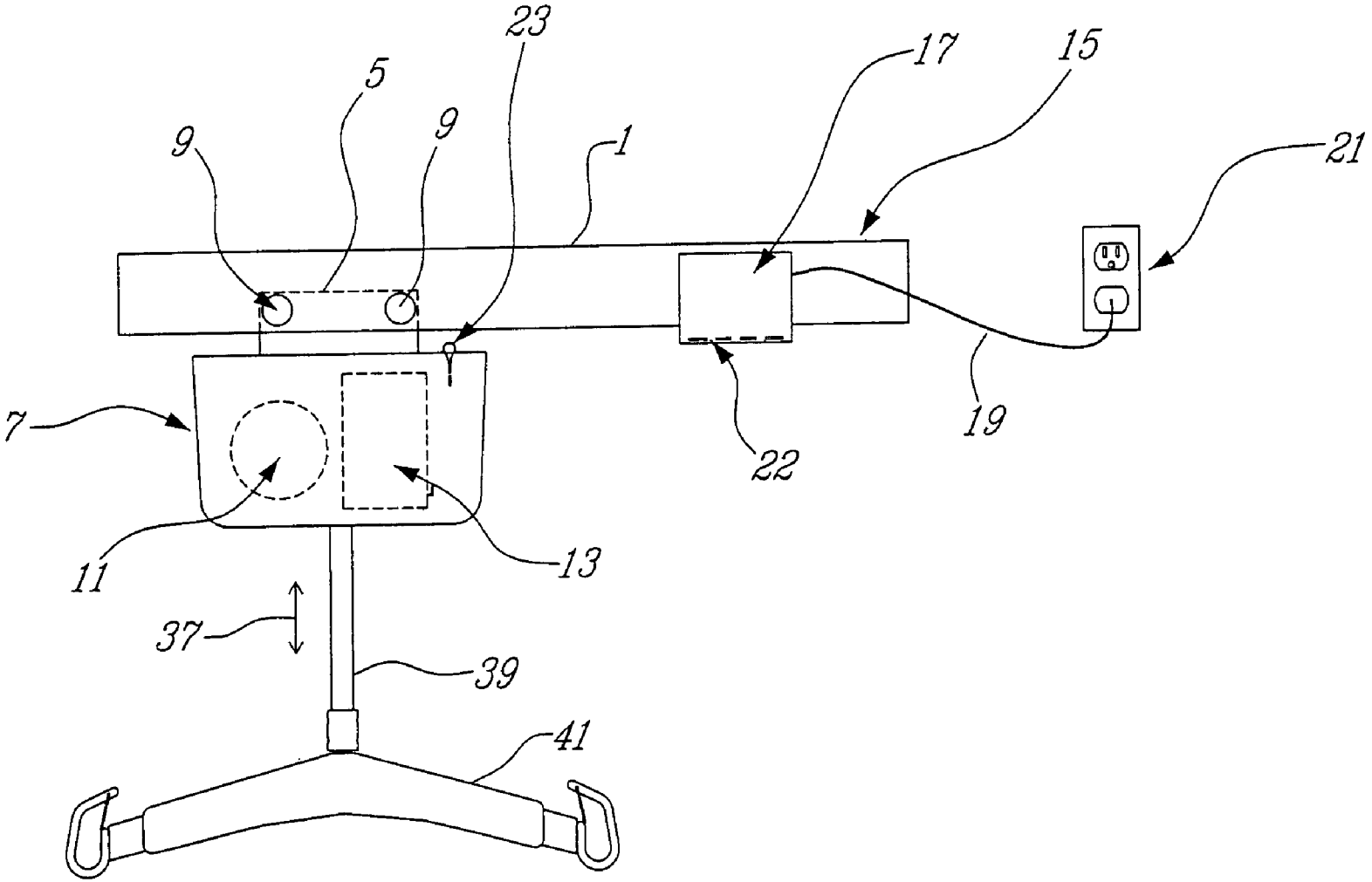

Turning to FIGS. 3*a*, 3*b* and 3*c* these figures illustrate in schematic fashion the variable functionality of a person handling system available in accordance with the present invention. In accordance with a person handling system of the present invention, the system includes a carriage displacement component comprising a motor element and a clutch coupling element able to couple and de-couple the motor to the trolley carriage. FIG. 3*a* illustrates possible movement of a supported person for a system in accordance with the present invention wherein the motor element is de-coupled from the trolley carriage such that horizontal movement of the winch supporting a person may be accomplished manually (i.e. by pulling or pushing the person in the support harness). FIG. 3*b* illustrates possible movement of a supported person for a system in accordance with the present invention wherein the motor element is coupled to the trolley carriage such that horizontal movement of the winch supporting a person may be accomplished by appropriate energizing of the trolley motor (i.e. by manipulation of the motor control means 40). FIG. 3*c* illustrates possible movement of the winch assembly to a recharge station either under motor power or else manually.

As mentioned above, in accordance with a person handling system of the present invention, the system includes a carriage displacement component comprising a motor element and a clutch coupling element able to couple and de-couple the motor to the trolley or carriage drive wheels. Referring to FIGS. 4 to 8, these figures illustrate a carriage component 43 and a winch assembly 45 which are associated, in accordance with the present invention, with a reversible carriage motor 47 and a coupling/de-coupling clutch mechanism indicated generally at 49. The carriage component comprises two pairs 51 and 53 of opposed wheels 55. The wheels 55 (of each pair of wheels) are disposed on opposite sides of a downwardly extending central projection or web 57. The winch assembly is attached to this central web as by welding, mechanical mating (e.g. tongue/mortise type components, rivets, etc.), or any other suitable or desired mechanism.

Figure 7:
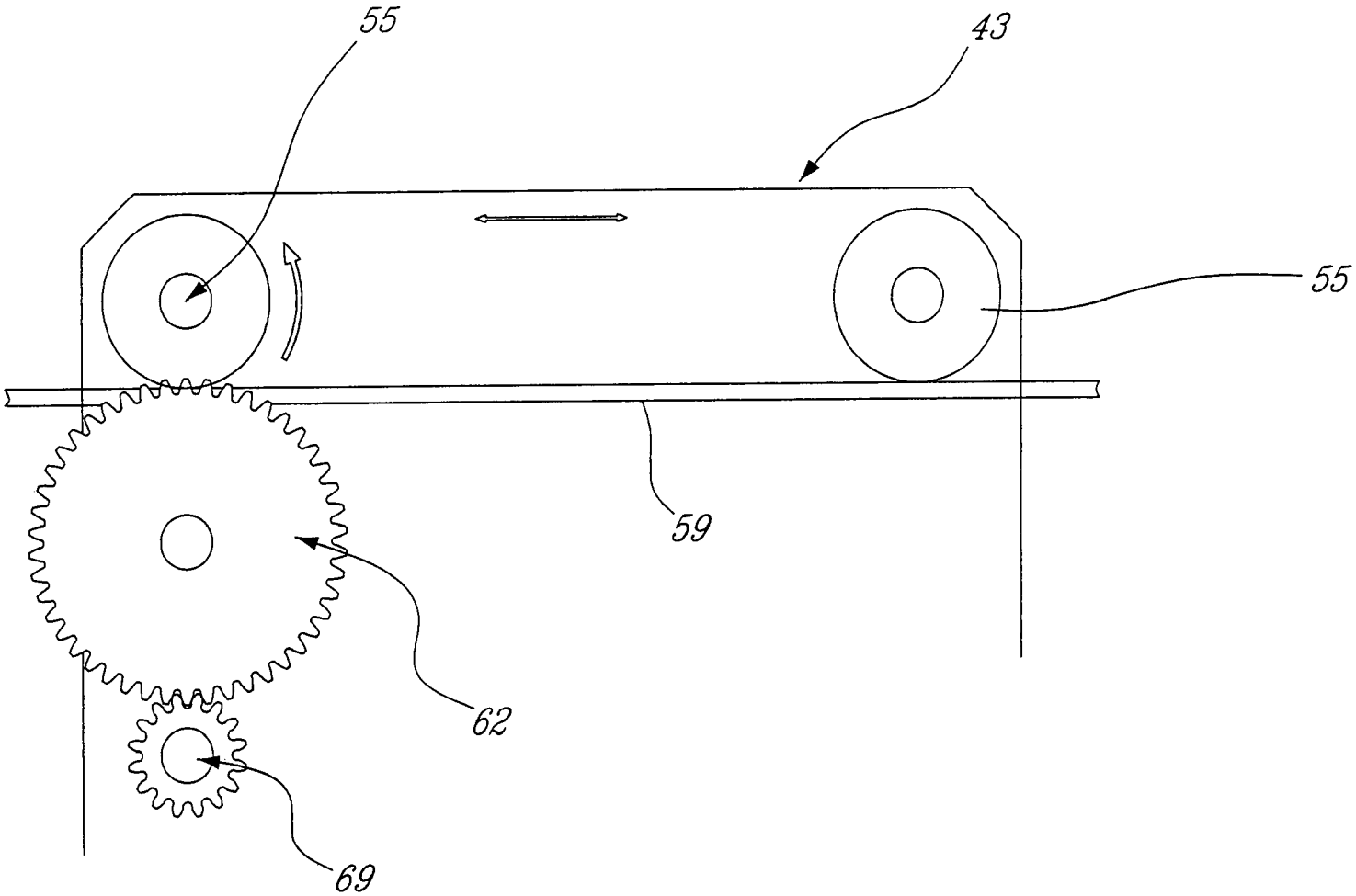
FIG. 7 shows a schematic partial side view of the trolley component of the winch assembly of FIG. 4 wherein the carriage wheels are engaging the side arms of a C-shaped rail element, a side of the rail being rempoved to expose the wheels.
Figure 8:
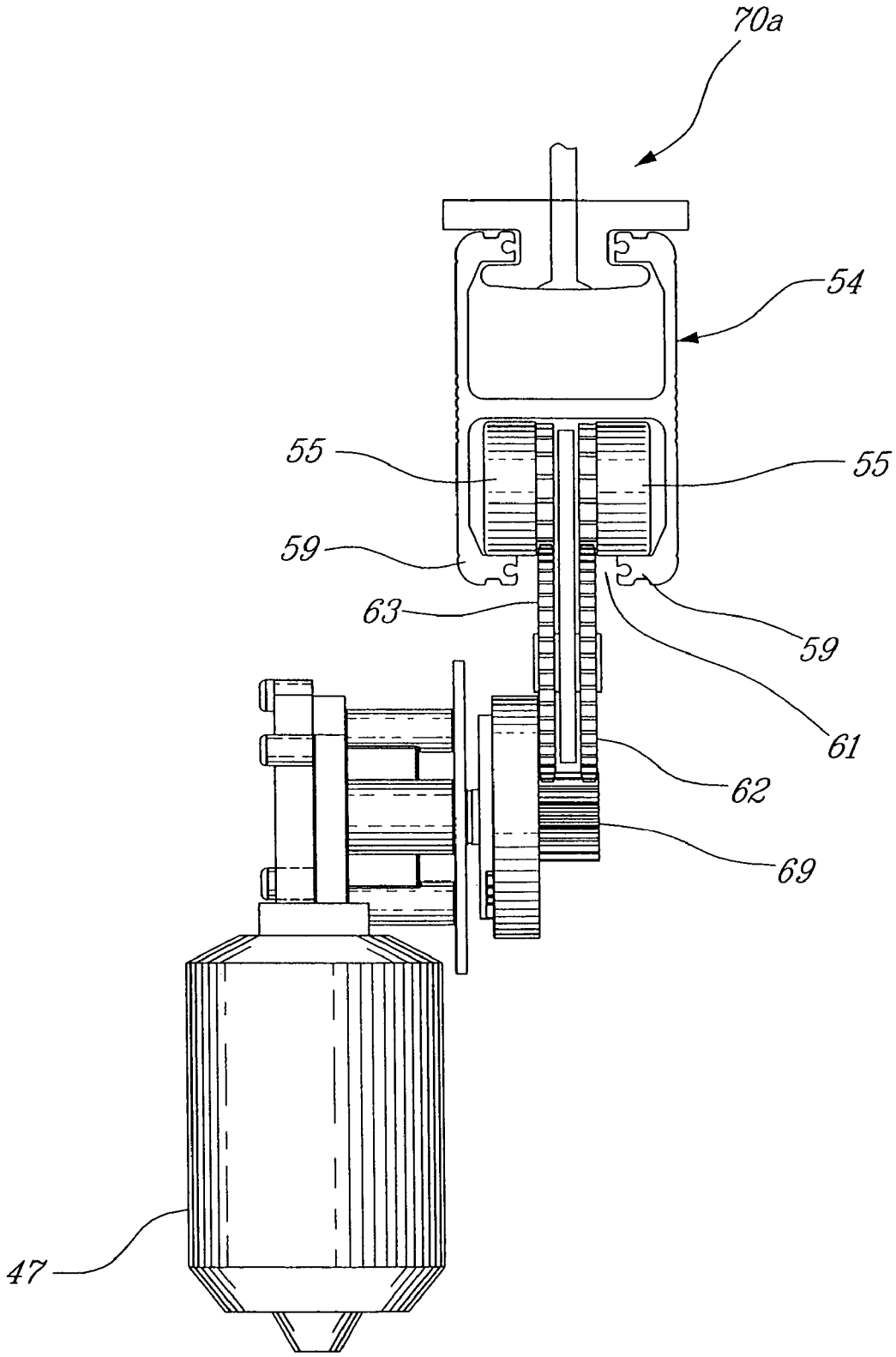
FIG. 8 is a cross-sectional view transverse to the longitudinal axis of a C-shaped rail element showing the carriage wheels engaged in the rail channel defined by the C-shaped rail element.

Turning to FIGS. 7 and 8 these schematically illustrate the engagement between the support rail element 54 and the roller wheels 55 of the carriage element. Each wheel 55 of a pair of wheels is supported on a respective inwardly projecting lip 59 of the rail element 54. The lips 59 define a longitudinally extending slot 61. The slot 61 is sized sufficiently so as receive therethrough not only the central projection or web 57 of the carriage but also the idler gear members 62 and 63. The periphery of each of the idler gear 62 and 63 is provided with sprocket or gear teeth which are sized and configured to mesh with corresponding engagement openings (one of which is designated by the reference numeral 67) disposed around the related carriage wheels 55; if desired, or necessary, such engagement may alternatively be frictional in nature. The driving effort from the motor 47 (once coupled) is transferred to the idler gears 62 and 63 by the drive gear member 69 which is part of the rotatable driven member of a coupling/de-coupling component. Also shown in the FIG. 8 is an example means of attaching the support rail to the ceiling of a room. The attachment means is shown in the form of a bracket 70*a* which is for example held to the ceiling by a screw or the like; the bracket is provided with wing flanges attached to the rest of the bracket by a trunk member. In use the rail is slide onto the bracket such that the flange are in the channel of the upper part of the rail and the upper slot receives the stalk of the flange.

The trolley or carriage component 43 once installed onto the track or rail may be displaced or rolled about or along the track component either manually or under power from the trolley motor as described herein.

Figure 9:
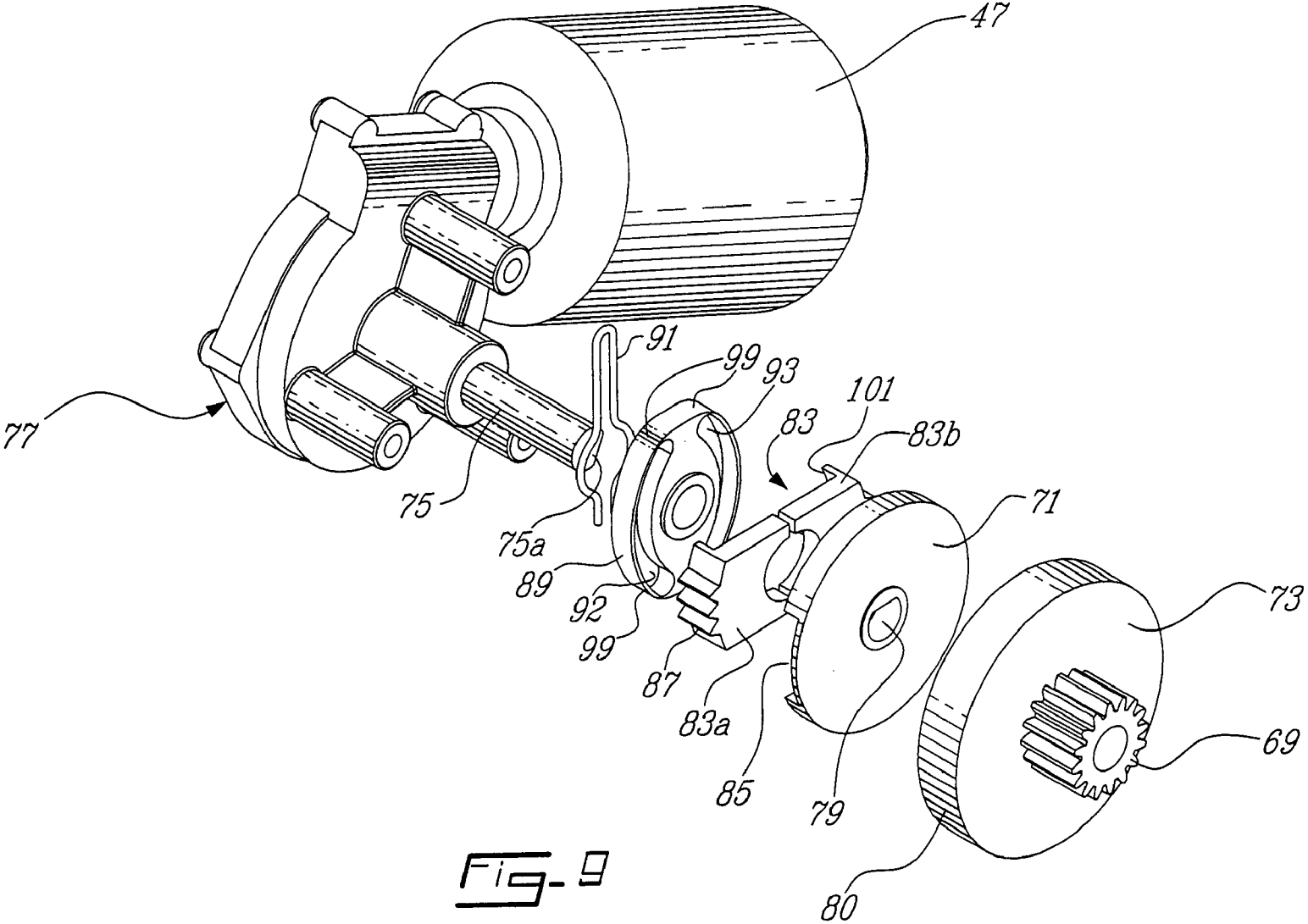
FIG. 9 is an exploded perspective side view of the trolley motor and coupling/de-coupling component of the winch assembly of FIG. 4.

Referring to FIGS. 9 and 10, these figures illustrate in exploded format an example structure for a coupling/de-coupling component of the present invention.

The driving member 71 and the driven member 73 are disposed coaxially relative to the axis of rotation of the drive shaft 75. Driving effort is transferable from the trolley motor 47 via the gearing member 77 to the drive shaft 75. The drive shaft 75 has a keyed end 75*a* for engagement in a correspondingly shaped central opening 79 in the rotatable driving member 71; the keyed end 75*a* and the opening 79 are shaped such that rotation of the drive shaft 75 will induce a corresponding rotation of the rotatable driving member 71. The rotatable driven member 73 on the other hand is coaxially mounted relative to the drive shaft 75 but does not engage the drive shaft 75 directly for its rotational movement. Rotational movement of the rotatable driven member 73 is induced by engagement between the driven member 73 and the driving member 71.

Thus for the purposes of such engagement the driven member 73 is provided with or is configured to define a peripheral annular or ring member 80. The annular or ring member 80 is provided with engagement means or elements in the form of internally extending sprocket or gear teeth (one of which is designated by the reference numeral 81) configured for engagement with engagement means or elements of the shuttle component (indicated generally as 83) as shall be discussed herein.

The rotatable driving member 71 on the other hand defines two slots 85 extending transversely (i.e. radially) to the axis of rotation of the drive shaft 75. The slots 85 are configured to accommodate the shuttle component 83. The shuttle component slidingly engages the wall elements of the driving member 71 defining the slots 85 such that the shuttle component is able to be displaced to and fro in the slots 85 transversely to the axis of rotation of the drive shaft 75; the shuttle component 83 is in any event engaged or mounted in the slots 85 such that rotation of the driving member 71 induces a like rotation of the shuttle component 83.

The shuttle component 83, as seen, comprises a pair of (opposed) separate slide members 83*a* and 83*b*; these two members 83*a* and 83*b* can be independently but simultaneously displaced radially outwardly or inwardly with respect to the drive shaft 75. For the embodiment shown, the shuttle component 83 (as well as the displacement element or member mentioned below) is configured such that displacement of the shuttle component for engagement with the gear teeth 81 of the annular or ring member 80 is able to provide a reversible type of driving effort (i.e. a driving effort alternatively in either the first or the second rotational direction); the direction of rotation being dictated by the direction of rotation of the drive shaft.

Thus the opposed ends of the slide members 83*a* and 83*b* of the shuttle component are provided with any suitable (corresponding) engagement means configured for mating engagement or meshing with the engagement means or elements of the annular or ring member 80; namely, corresponding externally or outwardly extending sprocket or gear teeth 87 for mating engagement or meshing with the internally or inwardly extending sprocket or gear teeth 81 of the ring member 80.

In accordance with the embodiment shown in FIGS. 9 and 10, the means for engaging and disengaging the clutch mechanism comprises a displacement element or member 89 mounted on the drive shaft 75; the displacement element or member 89 has a generally ovoid type of shape. The displacement member 89 includes a deformable collar element 89*a* which in conjunction with the spring clamp 91 frictionally clamps the displacement member 89 to the drive shaft 75. The frictional clamping is predetermined so as to provide sufficient frictional force to allow the drive shaft 75 to induce rotation of the displacement member 89 sufficient to force the separate slide members 83*a* and 83*b* apart until the gear teeth thereof mesh with the inner gear teeth of the annular or ring member 80 and thereafter the collar element 89*a* slip about the drive shaft 75 as it rotates.

The displacement element or member 89 is provided with a pair of curved cam slots 92 and 93 each curved slot being configured to slidingly engage a respective projection 95 and 97 extending axially from a respective separate slide member of the shuttle component 83. The displacement member 89 is also provided with opposed ends having curved (cam) corners 99 for engagement with the inner curved surfaces 101 behind the respective gear teeth. The structure of the displacement member 89 is such so as to induce displacement of the shuttle component in the slots 85 in response to a rotational movement of said drive shaft 75. Thus, in response to a rotational movement of the drive shaft 75, the displacement element or member 89 is able to engage the shuttle component 83 so as to induce the shuttle component to alternately extend from and/or retract into said slot 85 into engagement or disengagement with the annular or ring member (e.g. by the intermeshing of gear teeth 81 and 87).

In other words as the ovoid shaped displacement member 89 is rotationally displaced so that its ends each mates with the inner curved surfaces 101 of the shuttle members this action causes the projections 95 and 97 of the shuttle slide members 83*a* and 83*b* to be pushed along the curved cam slots 92 and 93 inducing displacement of the corresponding slide member until the ovid member is in-line with the longitudinal axis passing through each of the slide members; this is the engagement configuration for the driven member and the driving member. Once in the extended configuration, the teeth of the shuttle member will engage the interior teeth of the driven member 73 and in turn induce rotation of the drive wheels 55 of the trolley to cause the trolley to move. Disengagement is induced by rotation of the drive shaft 75 in the opposite direction a sufficient degree such that the ovoid member is disposed transversely to the said longitudinal axis; i.e. once the motor inducing motion is stopped, the ovoid member is returned to the neutral non-engagement position by rotation of the ovoid member by the motor in the opposite direction (a ¼ turn) so as to cause the two slide members to retreat into the slots 85 and de-couple the driven member 73 and the driving member 71. In this manner it is to be understood that the rotation during the transfer of a driving effort may be clockwise or counterclockwise depending on the direction of rotation of the drive shaft.

It can be appreciated that when the ovoid is in the non engagement or neutral position the drive motor is not connected i.e. it is decoupled from the carriage wheels. This configuration will permit the manual displacement of the winch assembly along the support track or rail i.e. the motor itself will not offer any resistance to such displacement since it is no longer connected to the carriage wheels.

Referring to FIGS. 10*a*, 10*b*, 10*c*, 10*d* and 10*e*, these figures illustrate in general schematic fashion the process of engaging and disengaging of the reversible motor 47 and driven member 73. As may be seen from FIG. 10*a*, the shuttle slide members 83*a* and 83*b* are in a retracted state which permits manual displacement of the carriage 43 since the motor 47 is no longer able to act as a brake to such movement. Referring to FIGS. 10*b* and 10*c*, when motorised movement of the carriage 43 is desired a pressure start button of a motor control means is depressed and held down until such time as the carriage has been moved the desired distance; the pressure button is of course to be configured such that the motor 47 will only be energised in the desired rotational direction as long as the button is depressed. As may be seen from FIG. 10*c* rotation of the shaft 75 induces the slide members to extend radially outward to engage the inner teeth 81 which in turn passes the rotation movement on to the driven member 73 and its gear 69. As maybe seen from FIGS. 7 and 8 rotation of gear 69 will induce the rotation of the wheels 55 coupled to the idler gears 62 and 63 and thus cause displacement of the carriage 43. Once the desired distance has been traveled the user releases the pressure start button. The motor control means is, however, provide with any suitable sensing means for generating a signal indicative of the release of the start button; this signal is feed to a control circuit which is configured to induce the motor to operate in an opposite direction for a predetermined opposite rotation of the drive shaft 75; i.e. the motor control means induces the motor to kick back in an opposite rotational direction so as to disengage the slide members and the inner teeth 81. Alternatively, the motor 47 may of course itself be chosen on the basis that on ceasing to be energised the motor will induce a slight opposite kickback sufficient to induce decoupling as discussed herein. The retraction of the slide members 83*a* and 83*b* may of course be accomplished by any other mechanically equivalent means e.g. by bias spring means; the slide members being biased in the retracted position and being flung outwardly against such bias on rotation of the shaft 75.

A rechargeable battery may be provided for energizing the trolley motor. Such a known system may further be associated with a battery recharging station. It is also known to associate with such motorized winch means a trolley motor control mechanism. The trolley control mechanism is configured in any suitable manner so as to provide a first function whereby the trolley motor may be activated to displace the trolley component along the rail a desired distance. The trolley control mechanism is also configured to provide a second (or recharge) function whereby the trolley motor may be activated so as to automatically displace the winch mechanism to a recharging station where the battery may be recharged; the mechanism and the recharge station being provided with suitable corresponding electrical connector means to achieve this purpose; the station being for example connected to an suitable source of electrical power.

Although the winch assembly has been discussed in terms of using a battery as a source of electrical power, it is of course to be understood that the motor may be connected to a source of electrical power by any other (known) means.

Referring to FIGS. 11 and 11*a* these illustrate an alternate embodiment of a clutch mechanism wherein the shuttle component 100 is of unitary construction and the displacement member comprises a friction clamp 110 which can frictionally grip the sleeve 112 of an anchor element 113 (which is disposed about a shaft drive shaft) with sufficient force to rotate while pushing against the projections 115 so as to induce engagement (or disengagement) and then the gripping part of the friction clamp 110 gripping the sleeve 112 is able to slide or slip about the shaft as it rotates. Otherwise the clutch mechanism of this embodiment is constructed in more less similar fashion and operates in much the same manner as that shown in FIGS. 9 and 10. FIGS. 11*b*, 11*c* and 11*d* show the displacement of the unitary shuttle component 100.

Figure 5:
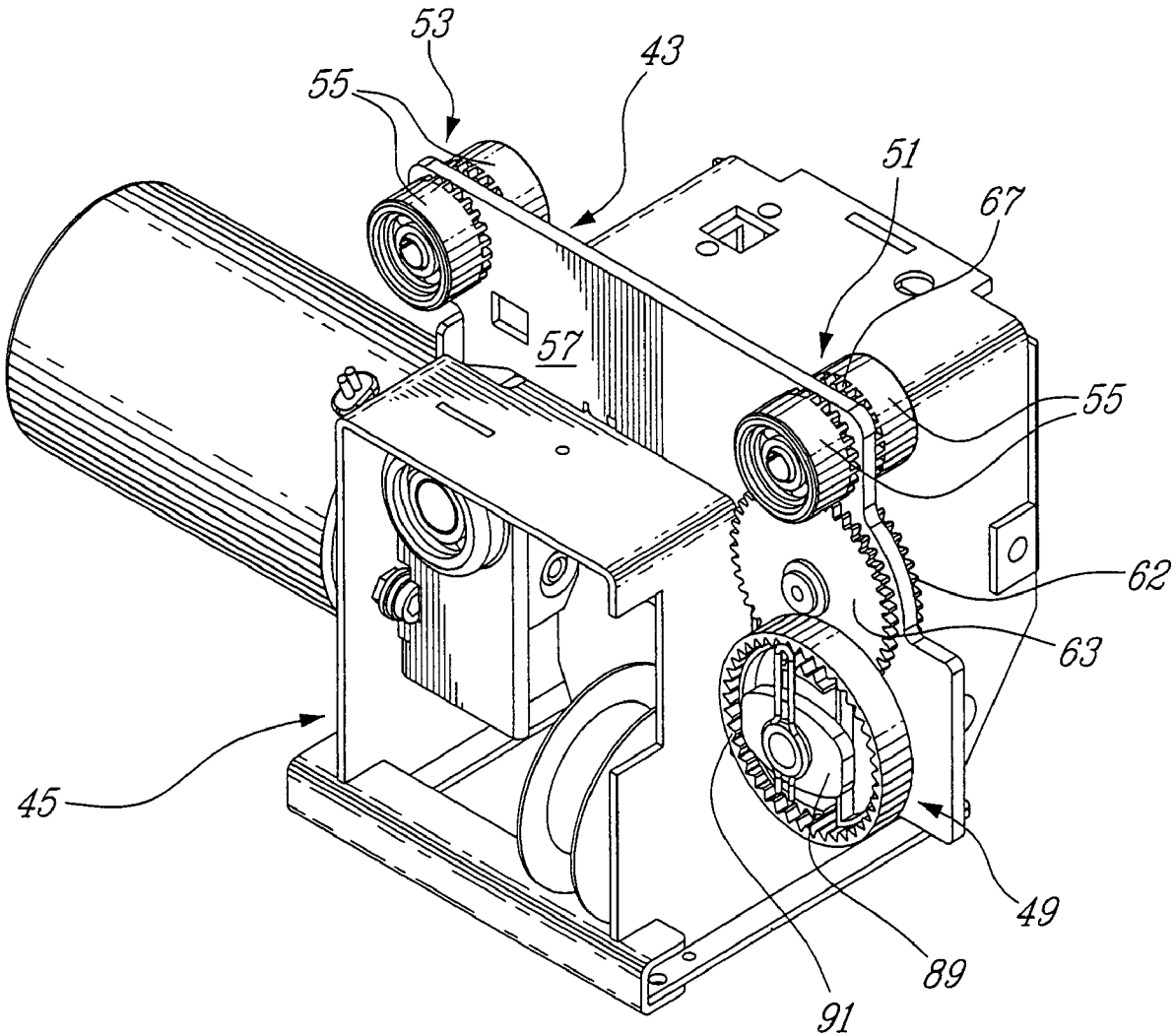
FIG. 5 shows the same perspective side view as in FIG. 4 but wherein the trolley motor and the housing of the coupling/de-coupling component are removed to expose the elements of the coupling/de-coupling component.
Figure 6:
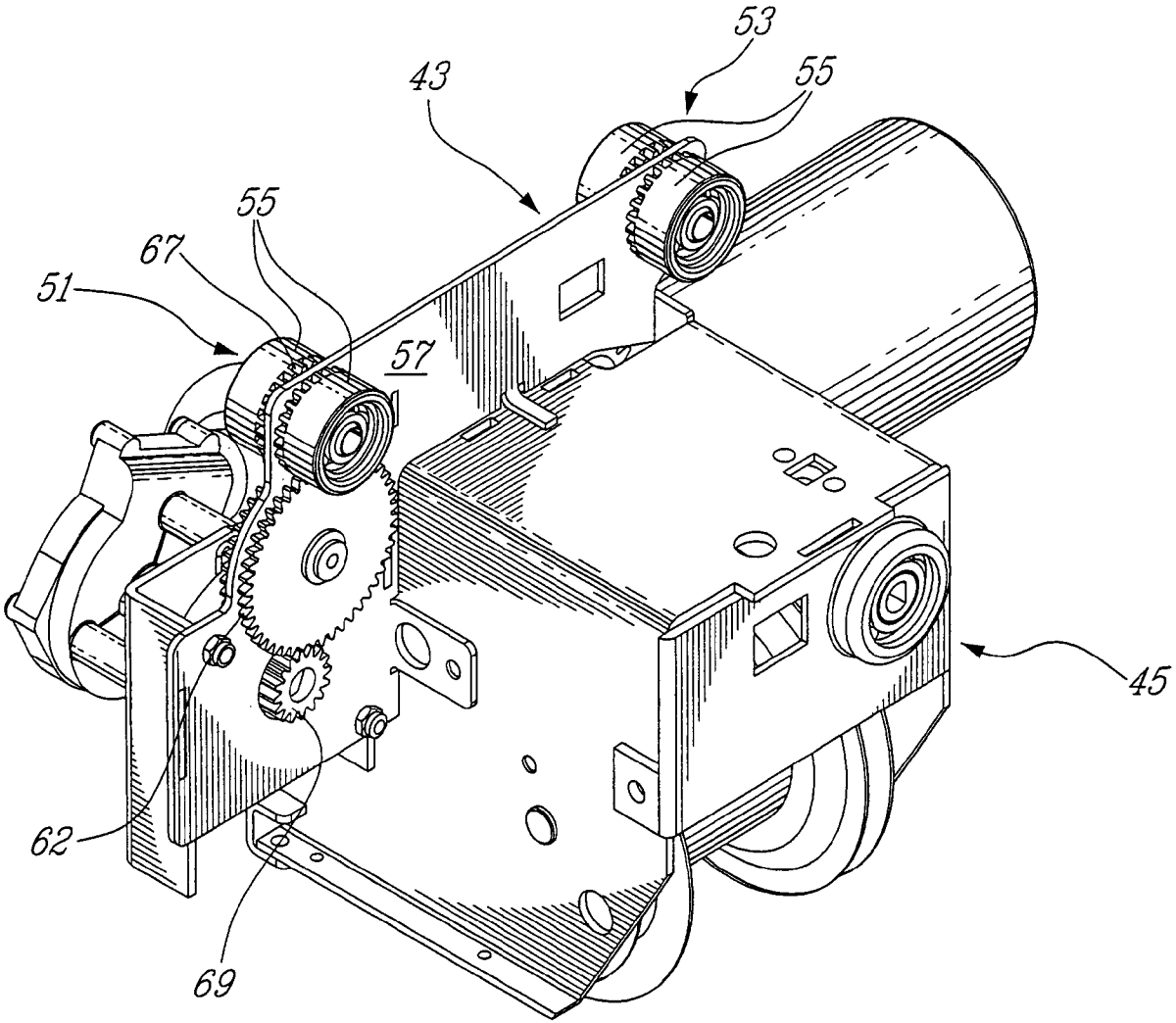
FIG. 6 shows a perspective side view of the winch assembly shown in FIG. 4 but as seen from the opposite side thereof.

The carriage system of the present invention as shown above may also be advantageously applied to an X-Y system. Thus in accordance with the present invention, the X-Y system as shown in schematic fashion in FIGS. 12 to 15 has a transverse rail 125 connected to the parallel secondary 126 and 127 rails by two roller carriages 128 and 129; the carriage 129 is a motorized carriage having a construction analogous to that of the carriage displacement component discussed with respect to FIGS. 9 and 10 above (see also FIGS. 4, 5 and 6). The motorised carriage 129 has the same type of motor element 47 and clutch coupling element 49 as shown in FIGS. 9 and 10 but does not of course have a winch assembly associated therewith; the motorised carriage 129 may be provided with a rechargeable battery (not shown) for exergizing the motor 47. The motorised carriage has the same type of carriage component 43 as also shown in FIGS. 4, 5 and 6 but carriage component 43 is further provided with horizontal stabilization rollers 130 for engaging the side wall of the channel of the secondary rail 127. The carriage component 43 is further attached (e.g. by rivets, nut/bolt combinations, etc.) to a lower carriage component 143 (wheels/roller not shown) of the same construction (but unmotorised) for connecting the carriage component 43 to the transverse rail 125; when viewed for the top the two carriage elements together have a cross-like aspect. The roller carriage 128 (see FIG. 15*a*) has the same type of construction as the carriage 129 except that it is not associated with a motor and clutch as is in the case of carriage 129. An alternate carriage construction 128*a* is shown in FIG. 15*b*; as may be seen the lower carriage component is not provided with wheels but instead has slider members 145 for sliding engagement with the inner walls of a rail channel.

The shown X-Y system can have both the advantages of a fully motorized system and those of a manual system i.e. when the respective clutches are not engaged, the motor for the winch assembly and/or the motor for the transverse rail, the winch assembly and/or the transverse rail may be displaced manually in accordance with the desires or needs of the operator.

As mentioned above the clutch mechanism may take on any other desired or necessary form. FIGS. 16, 16*a*, 17*a*, 17*b*, 17*c* and 18 illustrate in schematic fashion other forms of clutch mechanisms. Turning to FIGS. 16 and 16*a*, these figures show a clutch mechanism using a magnetic coupler 150 to couple the motor 47 to the gear 69. FIGS. 17*a*, 17*b* and 17*c* show a clutch mechanism using a using a secondary motor 153 to displace a mechanical coupler element 155 to couple the motor 47 to the gear 69. The coupler in FIG. 18 on the other hand exploits a rocker arm 160 attached to a pivot 162. The motor 47 is attached at one end of the arm and a friction roller 163 is attached to the other end of the arm 160. The motor 47 is coupled to the friction roller 163 by a pulley means not shown. The mechanism is also provided with displacement means not shown for pivoting the rocker arm 160 up and down in the direction of the arrow 164 so as to engage or disengage the friction roller 163 with the underside of rail 168.

Referring to FIGS. 19*a*, 19*b*, 19*c* and 19*d*, the X-Y system described above may also, for example, be provided with a suitably configured (mechanically and/or electronic) control means 170 for provoking the returning or displacing of the winch assembly 45 to a recharge station 15 automatically. The recharging station 15 may for example (as shown at an end of secondary rail 127) be disposed at one end of one of the two parallel secondary rails. The control means 170 may for example comprise recharge switch means (not shown).

The recharge switch means may be configured in any suitable fashion to cooperate with the carriage motor and rechargeable battery of the winch assembly 45 such that once the recharge switch means is triggered (i.e. placed in the "on" configuration), the carriage battery energizes the winch assembly carriage motor so as to induce the winch assembly 45 to travel along the transverse rail (in the direction of the arrow 172), i.e. toward the end thereof provided with the motorised carriage 129 of the transverse rail 125

The winch assembly 45 may be provided with a further primary switch means (indicated generally at 176) configured to electrically disconnect the winch assembly motor battery from the winch assembly carriage motor once the winch assembly has arrived at a predetermined position adjacent the end of the transverse rail, i.e. the primary switch means 176 may comprise a physical projection (i.e. pole) displaceable from an "on" position to an "off" position by contact with the secondary rain or projection thereof. Once the pole is in the "off" position the winch assembly carriage motor is no longer energised by the battery and movement along the transverse rail is stopped.

The motorised carriage 129 of the transverse rail on the other hand may also be provided with secondary switch means indicated generally at 178). The secondary switch means 178 may be configured in any suitable or desired fashion to electrically connect the battery of the transverse rail carriage motor with the transverse rail carriage motor once the winch assembly has arrived at a predetermined position adjacent the end of the transverse rail, i.e. the secondary switch means 178 may thus also comprise a physical projection (i.e. pole) displaceable from an "off" position to an "on" position by contact with the housing of the winch assembly. Once the pole is in the "on" position the transverse rail carriage motor is energised and induces the transverse rail to travel in the direction of the arrow 180 towards the recharge station 15.

The motorised carriage of the transverse rail may also be provided with an additional tertiary switch means (indicated generally at 182). The tertiary switch means 182 may be configured in any suitable or desired fashion to electrically disconnect the battery of the transverse rail carriage motor from the transverse rail carriage motor once the winch assembly has arrived at the recharge station, i.e. the tertiary switch means may thus also comprise a physical projection (i.e. pole) displaceable from an "on" position to an "off" position by contact with the housing of the recharge station or projection thereof. Once the pole is in the "off" position the transverse rail carriage motor is no longer energised and movement of the transverse rail is halted once the winch assembly rechargeable battery is brought into electrical connection with the battery recharge station (see above FIG. 3*d* for such electrical connection.).

As may be appreciated from the above, under the sequential influence of the drive motors mentioned above the winch assembly may be made to travel along the transverse rail and then the transverse rail may be made to carry the winch assembly to the recharge station in automatic fashion.

Thus in accordance with the invention when the operator desires to send the system to the recharging configuration, the operator merely presses the appropriate button (i.e. switch control) on the control means 170. In this case the control means will initiate motorization of the winch assembly followed by motorization of the transverse bar so that motion of the winch assembly coupled with motion of the transverse bar will transport the winch assembly to the charging station. It is of course to be understood that at the recharge station 15, the battery for the tranverse rail carriage motor may also, if so desired or necessary be recharged as described herein (see FIG. 3*d* for an example of such electrical connection which may be adjusted as necessary or desired to permit such recharging).

Alternatively with both carriage motors in the de-coupled configuration the winch assembly may be manually displaced to the recharge station, i.e. along the transverse rail and then the transverse rail to the recharge station.

We claim:

1. A person handling system carriage assembly, said carriage assembly comprising a) a carriage component, said carriage component comprising a wheel element configured for coupling said carriage component to a carriage track of an overhead support for displacement thereof along said carriage track and b) a displacement component for inducing displacement of said carriage component along said carriage track, said displacement component comprising an electric motor element and a clutch coupling element said clutch coupling element being configured for coupling and de-coupling said electric motor element and said wheel element such that when said electric motor element and said wheel element are coupled and said electric motor element is energised said carriage component may be urged along said carriage track by said electric motor element and when said electric motor element and said wheel element are de-coupled said carriage component may be manually displaced along said carriage track.

2. A carriage assembly as defined in claim 1 wherein said clutch coupling element is a magnetic clutch coupling element.

3. A carriage assembly as defined in claim 2 wherein said carriage component is coupled to said carriage track by said wheel element.

4. A carriage assembly as defined in claim 3 wherein said carriage component is coupled to said carriage track by said wheel element.

5. A carriage assembly as defined in claim 4 wherein said carriage track is connected to second and third carriage components, each of said second and third carriage components comprising a respective wheel element respectively coupling said second and third carriage components to a respective secondary track for displacement thereof along said respective secondary track, each of said secondary tracks being disposed transversely with respect to said carriage track, said secondary tracks being spaced apart.

6. A carriage assembly as defined in claim 1 wherein said clutch coupling element comprises a drive shaft able to be rotated in a first direction, said drive shaft being coupled to said electric motor element a rotatable driving member coupled to said drive shaft such that rotation of the drive shaft induces rotation of the rotatable driving member a rotatable driven member coupled to said wheel element for urging said carriage component along said carriage track a clutch member for coupling and decoupling said driving member with said driven member in response to rotation of said drive shaft said clutch member being configured to couple said driving member with said driven member for urging the driven member to rotate in said first direction for urging said carriage component along said carriage track.

7. A carriage assembly as defined in claim 6 wherein said drive shaft is able to be rotated in a second direction opposite to said first direction, said clutch member being additionally configured to couple said driving member with said driven member for urging the driven member to rotate in said second direction opposite to said first direction for urging said carriage component in an opposite direction along said carriage track.

8. A carriage assembly as defined in claim 7 wherein said clutch member comprises a first clutch component configured to couple said driving member with said driven member for urging the driven member to rotate in said first direction a second clutch component configured to couple said driving member with said driven member for urging the driven member to rotate in said second direction opposite to said first direction a means for engaging said first clutch component and disengaging said second clutch component in response to rotation of said drive shaft in said first direction and a means for engaging said second clutch component and disengaging said first clutch component in response to rotation of said drive shaft in said second direction.

9. A carriage assembly as defined in claim 8 wherein a person lowering and raising winch component is attached to said carriage component.

10. A carriage assembly as defined in claim 9 wherein said carriage component is coupled to said carriage track by said wheel element.

11. A carriage assembly as defined in claim 10 wherein said carriage track is connected to second and third carriage components, each of said second and third carriage components comprising a respective wheel element respectively coupling said second and third carriage components to a respective secondary track for displacement thereof along said respective secondary track, each of said secondary tracks being disposed transversely with respect to said carriage track, said secondary tracks being spaced apart.

12. A carriage assembly as defined in claim 7 wherein a person lowering and raising winch component is attached to said carriage component.

13. A carriage assembly as defined in claim 12 wherein said carriage component is coupled to said carriage track by said wheel element.

14. A carriage assembly as defined in claim 13 wherein said carriage track is connected to second and third carriage components, each of said second and third carriage components comprising a respective wheel element respectively coupling said second and third carriage components to a respective secondary track secondary tracks being disposed transversely with respect to said carriage track, said secondary tracks being spaced apart.

15. A carriage assembly as defined in claim 6 wherein a person lowering and raising winch component is attached to said carriage component.

16. A carriage assembly as defined in claim 15 wherein said carriage component is coupled to said carriage track by said wheel element.

17. A carriage assembly as defined in claim 16 wherein said carriage track is connected to second and third carriage components, each of said second and third carriage components comprising a respective wheel element respectively coupling said second and third carriage components to a respective secondary track for displacement thereof along said respective secondary track, each of said secondary tracks being disposed transversely with respect to said carriage track, said secondary tracks being spaced apart.

18. A carriage assembly as defined in claim 1 wherein a person lowering and raising winch component is attached to said carriage component.

19. A carriage assembly as defined in claim 18 wherein said carriage component is coupled to said carriage track by said wheel element.

20. A carriage assembly as defined in claim 19 wherein said carriage track is connected to second and third carriage components, each of said second and third carriage components comprising a respective wheel element respectively coupling said second and third carriage components to a respective secondary track for displacement thereof along said respective secondary track, each of said secondary tracks being disposed transversely with respect to said carriage track, said secondary tracks being spaced apart.

* * * * *